US009807497B2

(12) United States Patent
Nakadai

(10) Patent No.: US 9,807,497 B2
(45) Date of Patent: Oct. 31, 2017

(54) SOUND SOURCE LOCALIZATION DEVICE, SOUND PROCESSING SYSTEM, AND CONTROL METHOD OF SOUND SOURCE LOCALIZATION DEVICE

(71) Applicant: HONDA MOTOR CO., LTD., Tokyo (JP)

(72) Inventor: Kazuhiro Nakadai, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 14/949,988

(22) Filed: Nov. 24, 2015

(65) Prior Publication Data

US 2016/0212525 A1 Jul. 21, 2016

(30) Foreign Application Priority Data

Jan. 15, 2015 (JP) ..... 2015-005809

(51) Int. Cl.
*H04R 1/40* (2006.01)
*H04R 5/027* (2006.01)
*H04R 29/00* (2006.01)

(52) U.S. Cl.
CPC ..... *H04R 1/406* (2013.01); *H04R 5/027* (2013.01); *H04R 29/005* (2013.01); *H04R 2201/405* (2013.01); *H04R 2499/15* (2013.01)

(58) Field of Classification Search
CPC ..... H04R 1/406; H04R 5/027; H04R 29/005; H04R 2201/405; H04R 2499/15
USPC ..... 381/92, 304–306
See application file for complete search history.

(56) References Cited

U.S. PATENT DOCUMENTS 7,646,876 B2 * 1/2010 Chu ..... H04N 7/142 348/14.01
9,285,452 B2 * 3/2016 Tammi ..... G01S 3/8006
2012/0128175 A1 * 5/2012 Visser ..... H04R 3/005 381/92
2012/0284619 A1 * 11/2012 Myllyla ..... H04R 29/008 715/716
2013/0121498 A1 * 5/2013 Giesbrecht ..... H04M 9/082 381/66
2013/0190041 A1 * 7/2013 Andrews ..... H04R 3/005 455/556.1
2013/0343572 A1 * 12/2013 Lee ..... H04M 1/03 381/92
2014/0105416 A1 * 4/2014 Huttunen ..... H04R 5/027 381/92
2014/0185814 A1 * 7/2014 Cutler ..... H04R 5/04 381/26
2015/0304786 A1 * 10/2015 Partio ..... H04R 25/305 381/58

FOREIGN PATENT DOCUMENTS

FI WO 2014037765 A1 * 3/2014 ..... H04R 29/005
JP 2014-098573 5/2014

* cited by examiner

*Primary Examiner* — David Ton
(74) *Attorney, Agent, or Firm* — Rankin, Hill & Clark LLP

(57) ABSTRACT

A sound source localization device, which has a plurality of sound pickup devices which record a sound signal and specifies a direction of a sound source based on sound signals recorded by at least two sound pickup devices of the sound pickup devices, includes a notification device that notifies information based on an arrangement of the sound pickup devices.

9 Claims, 20 Drawing Sheets

SOUND SOURCE LOCALIZATION DEVICE, SOUND PROCESSING SYSTEM, AND CONTROL METHOD OF SOUND SOURCE LOCALIZATION DEVICE

CROSS-REFERENCE TO RELATED APPLICATION

This application is based upon and claims the benefit of priority from the prior Japanese Patent Application No. 2015-005809, filed on Jan. 15, 2015, the entire contents of which are incorporated herein by reference.

BACKGROUND OF THE INVENTION

Field of the Invention

The present invention relates to a sound source localization device, a sound processing system, and a control method of the sound source localization device.

Description of Related Art

A device in which a microphone is connected or attached in four directions or more of a mobile phone terminal or a tablet terminal to specify a sound source direction and notify the specified sound source direction has been proposed. The microphone is arranged, for example, at four corners of the mobile phone terminal (for example, see Japanese Unexamined Patent Application, First Publication No. 2014-98573).

SUMMARY OF THE INVENTION

However, according to the technique described in Japanese Unexamined Patent Application, First Publication No. 2014-98573, some of a plurality of microphones may be covered with the fingers or hands of a user. Thus, if some of the microphones are covered with the user's fingers or hands, there has been a problem that the accuracy of sound source localization for specifying a sound source position decreases.

In view of the above problem, it is an object of the present invention to provide a sound source localization device that can improve the accuracy of sound source localization, a sound processing system, and a control method of the sound source localization device.

In order to achieve the above object, the present invention adopts the following aspects.

(1) A sound source localization device according to an aspect of the present invention, that has a plurality of sound pickup devices which record a sound signal and specifies a direction of a sound source based on sound signals recorded by at least two sound pickup devices of the sound pickup devices, includes a notification device that notifies information based on an arrangement of the sound pickup devices.

(2) In the aspect of (1) above, the notification device may be at least one device of; a device that notifies information indicating a position where a user's hand is placed on a display section, a device that notifies information indicating a position where the user's hand is placed on a frame of the display section, a device that notifies information indicating a position where the user's hand is placed on an attachment attached to the sound source localization device, a device printed with a position where the user's hand is placed on the frame of the display section, a device printed with a position where the user's hand is placed on the attachment, and a device that notifies a position where the sound pickup device is arranged.

(3) In the aspect of either one of (1) and (2) above, there may be provided a sensor that detects a direction of the sound source localization device set by the user, and the notification device may notify the information based on the arrangement of the sound pickup devices according to the direction detected by the sensor.

(4) In the aspect of any of (1) through (3) above, as the plurality of sound pickup devices, n (n is an integer equal to or larger than 2) sound pickup devices are provided on the display section side of the sound source localization device, and m (m is an integer equal to or larger than 2) sound pickup devices are provided on an opposite side to the display section. A first microphone array is formed by the n sound pickup devices, and a second microphone array is formed by the m sound pickup devices. Moreover, there may be provided: a first imaging section provided on the display section side of the sound source localization device; a second imaging section provided on the opposite side to the display section; a determination section that selects either the first microphone array or the second microphone array based on an image imaged by the first imaging section and an image imaged by the second imaging section; and a sound source localization section that specifies the direction of the sound source by using a sound signal recorded by the microphone array selected by the determination section.

(5) In the aspect of (4) above, there may be provided: a detection section that detects a signal level of the sound signal respectively recorded by the plurality of sound pickup devices; and a sound signal selection section that selects a sound signal with the signal level higher than a predetermined value from the sound signals, and the sound source localization section may specify the direction of the sound source by using the sound signal selected by the sound signal selection section.

(6) In the aspect of (4) above, there may be provided a detection section that detects a signal level of the sound signal respectively recorded by the plurality of sound pickup devices, and the determination section may determine whether the signal level detected by the detection section is equal to or lower than a predetermined value, and control the sound pickup device that has recorded the sound signal with the signal level being equal to or lower than the predetermined value, to an off state, and the sound source localization section may specify the direction of the sound source by using the sound signal recorded by the sound pickup device in an on state.

(7) A sound processing system according to an aspect of the present invention is a sound processing system including a sound source localization unit and an information output device, wherein the sound source localization unit includes a plurality of sound pickup devices that record a sound signal; a sound source localization section that estimates a direction of a sound source by using sound signals recorded by the sound pickup devices; and a transmission section that transmits the direction of the sound source and sound signals recorded by the sound pickup devices. The information output device includes: a reception section that receives information indicating the direction of the sound source and the plurality of sound signals transmitted from the sound source localization unit; and a sound source separation section that performs sound source processing to separate sound signals for each sound source, based on the information indicating the direction of the sound source and the plurality of sound signals received by the reception section.

(8) In the aspect of (7) above, the transmission section of the sound source localization unit transmits information indicating positions of the plurality of sound pickup devices, and the reception section of the information output device receives the information indicating the positions of the plurality of sound pickup devices transmitted from the sound source localization unit, and the information output device may further include a notification device that notifies information based on an arrangement of the sound pickup devices, based on the received information indicating the positions of the plurality of sound pickup devices.

(9) A control method of a sound source localization device according to an aspect of the present invention is a control method of a sound source localization device that has a plurality of sound pickup devices which record a sound signal and specifies a direction of a sound source based on sound signals recorded by at least two sound pickup devices of the sound pickup devices, including: a notification procedure of notifying information based on an arrangement of the sound pickup devices according to a direction of the sound source localization device set by a user, which is detected by a sensor.

(10) In the aspect of (9) above, there may be include: a detection procedure of detecting a signal level of the sound signal respectively recorded by the plurality of sound pickup devices; a sound signal selection procedure of selecting a sound signal with the signal level higher than a predetermined value from the sound signals; and a sound source localization procedure of specifying the direction of the sound source by using the sound signal selected by the sound signal selection procedure.

(11) In the aspect of (9) above, there may be include: a detection procedure of detecting a signal level of the sound signal respectively recorded by the plurality of sound pickup devices; a determination procedure of determining whether the signal level detected by the detection procedure is equal to or lower than a predetermined value, to control the sound pickup device that has recorded the sound signal with the signal level being equal to or lower than the predetermined value, to an off state; and a sound source localization procedure of specifying the direction of the sound source by using the sound signal recorded by the sound pickup device that is controlled to an on state by the determination procedure.

According to the aspect of (1) above, the information based on the arrangement of the sound pickup devices can be notified.

Consequently, according to the present configuration, the user can arrange the hand at a position that does not cover the sound pickup device by confirming the notified information. As a result, according to the present configuration, because the sound pickup device is not covered with the user's hand, the accuracy of sound source localization can be improved by using the sound signals recorded by the plurality of sound pickup devices.

According to the aspect of (2) above, the information based on the arrangement of the sound pickup devices is displayed or printed on at least one of the display section, the frame, and the attachment (for example, a cover, a case, or a bumper). Therefore, the user can arrange the hand at a position that does not cover the sound pickup device by confirming the notified information. As a result, according to the present configuration, because the sound pickup device is not covered with the user's hand, the accuracy of sound source localization can be improved by using the sound signals recorded by the plurality of sound pickup devices.

According to the aspect of (3) and (9) above, an image indicating a position to arrange the hand can be displayed according to a state in which the user holds the sound source localization device. Accordingly, the user can arrange the hand at a position that does not cover the sound pickup device by confirming the notified information, regardless of the holding state. As a result, according to the present configuration, because the sound pickup device is not covered with the user's hand, the accuracy of sound source localization can be improved.

According to the aspect of (4) above, it can be selected whether to perform sound source localization by using the microphone array of the sound pickup devices on the display section side or perform sound source localization by using the microphone array of the sound pickup devices on the opposite side to the display section, based on the image imaged by the first imaging section provided on the display section side, and the image captured by the second imaging section provided on the opposite side to the display section. Consequently, according to the present configuration, sound source localization can be performed by using the microphone array on the side directed to the direction of the sound source, thereby enabling to improve the accuracy of sound source localization.

According to the aspects of (5), (6), (10), and (11) above, sound source localization, sound source separation, and voice recognition can be performed, excluding a sound pickup device with a low voice signal level, which is covered with the user's hand. Consequently, the accuracy of sound source localization, sound source separation, and voice recognition can be improved.

According to the aspect of (7) above, the sound source localization device can perform a sound signal separation process based on the sound signals recorded by the plurality of sound pickup devices, which are received from the sound source localization unit, and the information indicating the azimuth angle of the sound source.

According to the aspect of (8) above, the sound source localization device can notify information based on the arrangement of the sound pickup devices, based on the information indicating the positions of the plurality of sound pickup devices, received from the sound source localization unit. Consequently, according to the present configuration, because the sound pickup device is not covered with the user's hand, the accuracy of sound source localization can be improved by using the sound signals recorded by the plurality of sound pickup devices.

DETAILED DESCRIPTION OF THE INVENTION

First Embodiment

Hereunder, an embodiment of the present invention will be described with reference to the drawings.

Figure 1:
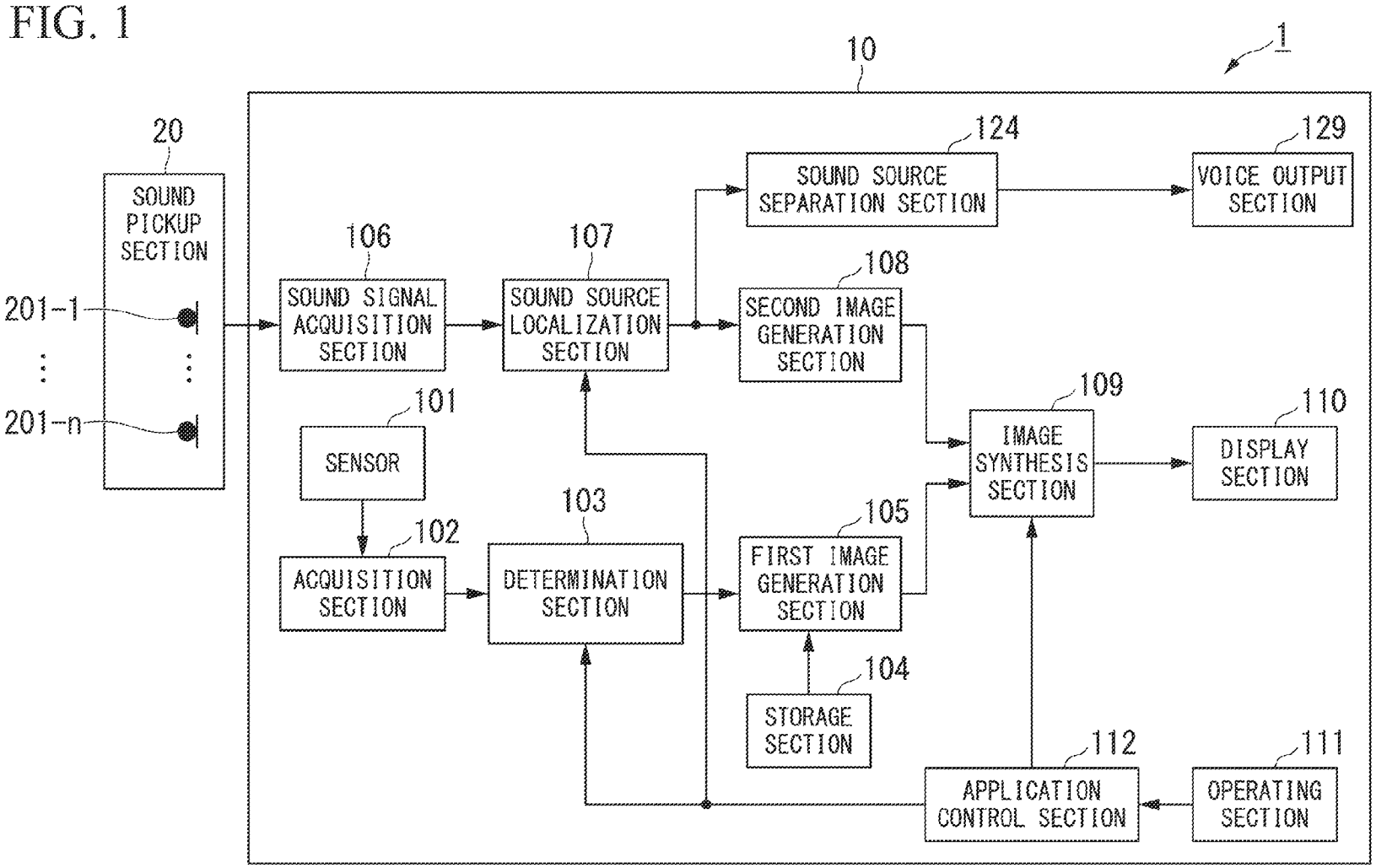
FIG. 1 is a block diagram showing a configuration of a sound processing system according to a first embodiment.

FIG. 1 is a block diagram showing a configuration of a sound processing system 1 according to a first embodiment. As shown in FIG. 1, the sound processing system 1 includes a sound source localization device 10 and a sound pickup section 20.

The sound pickup section 20 includes n sound pickup devices 201-1 to **201-*n* (n is an integer equal to or larger than 2) that receive sound waves having a component, for example, of a frequency band (for example, 200 Hz to 4 kHz). When any of the sound pickup devices 201-1 to 201-*n* is not specified, the sound pickup device is noted as sound pickup device 201. The sound pickup device 201 is a microphone. That is to say, the sound pickup section 20 forms a first microphone array including n sound pickup devices 201. The respective sound pickup devices 201-1 to 201-*n* output collected sound signals to the sound source localization device 10. The sound pickup section 20 may transmit recorded n-channel sound signals by wireless or by cable. It is sufficient that the sound signals are synchronized between the channels at the time of transmission. Moreover, the sound pickup section 20 may be attached detachably to the sound source localization device 10, or may be incorporated in the sound source localization device 10. In an example described below, an example in which the sound pickup section 20 is incorporated in the sound source localization device 10** will be described.

The sound source localization device 10 is, for example, a mobile phone, a tablet terminal, a mobile game terminal, or a notebook personal computer. In the explanation below, an example in which the sound source localization device 10 is a tablet terminal will be described. The sound source localization device 10 notifies to a display section of the sound source localization device 10, or a cover or a case attached to the sound source localization device 10, information based on an arrangement of the sound pickup devices 201.

Moreover, the sound source localization device 10 specifies a position of a sound source (also referred to as sound source localization) based on a sound signal input from the sound pickup section 20.

Next, the arrangement of the sound pickup devices 201 is described.

Figure 2:
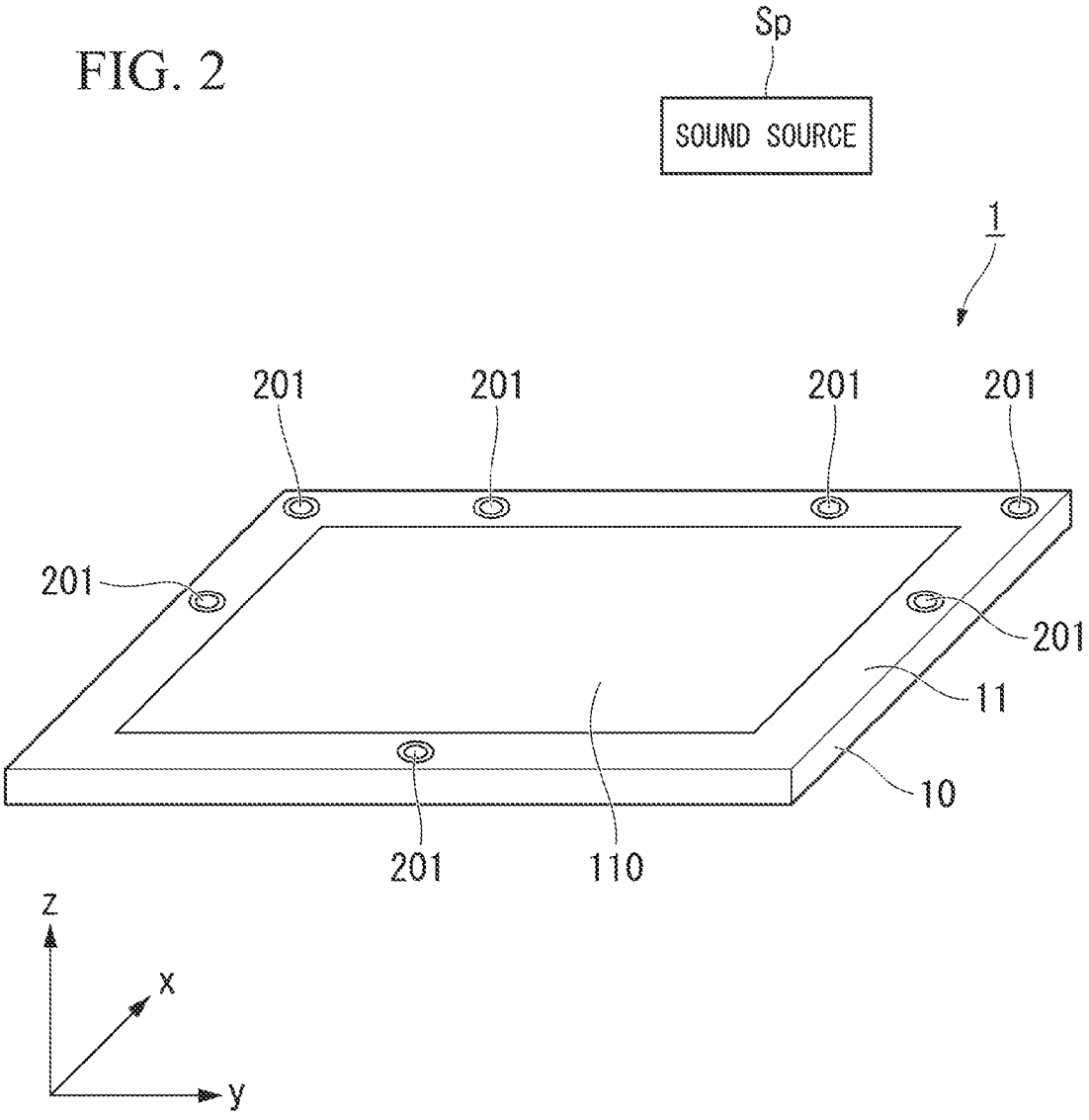
FIG. 2 is a diagram for explaining an arrangement of sound pickup devices according to the first embodiment.

FIG. 2 is a diagram for explaining the arrangement of the sound pickup devices 201 according to the present embodiment. In FIG. 2, it is assumed that the transverse direction of the sound source localization device 10 is the x-axis direction, the longitudinal direction is the y-axis direction, and the thickness direction is the z-axis direction. In the example shown in FIG. 2, the sound pickup section 20 includes seven sound pickup devices 201. The seven sound pickup devices 201 are arranged in the xy plane, and attached to a substantially peripheral part 11 (also referred to as frame) of a display section 110 of the sound source localization device 10. The number and arrangement of the sound pickup devices 201 shown in FIG. 2 is an example only, and the number and arrangement of the sound pickup devices 201 are not limited thereto. Moreover, in FIG. 2, reference symbol Sp denotes a sound source.

Next, returning to FIG. 1, a configuration of the sound source localization device 10 is described. The sound source localization device 10 includes; a sensor 101, an acquisition section 102, a determination section 103, a storage section 104, a first image generation section 105, a sound signal acquisition section 106, a sound source localization section 107, a second image generation section 108, an image synthesis section 109, the display section 110, an operating section 111, an application control section 112, a sound source separation section 124, and a voice output section 129.

The sensor 101 detects pitch about the X axis (see FIG. 1) of the sound source localization device 10, roll about the Y axis, and yaw about the Z axis, and outputs the detected pitch, roll, and yaw to the acquisition section 102 as rotation angle information. The sensor 101 is, for example, a geomagnetic sensor and an acceleration sensor. Alternatively, the sensor 101 detects angular speed of the sound source localization device 10, and outputs the detected angular speed to the acquisition section 102. The sensor 101 that detects the angular speed is, for example, a three-axis gyro sensor. The pitch, roll, and yaw detected by the sensor 101 are not in a coordinate system in the sound source localization device 10 shown in FIG. 2 (hereinafter, referred to as device coordinate system), but are values of a global coordinate system. Moreover, inclination information in the embodiment is rotation angle information or angular speed information.

The acquisition section 102 acquires the rotation angle information or the angular speed detected by the sensor 101, and outputs the acquired rotation angle information or the angular speed to the determination section 103.

Figure 6:
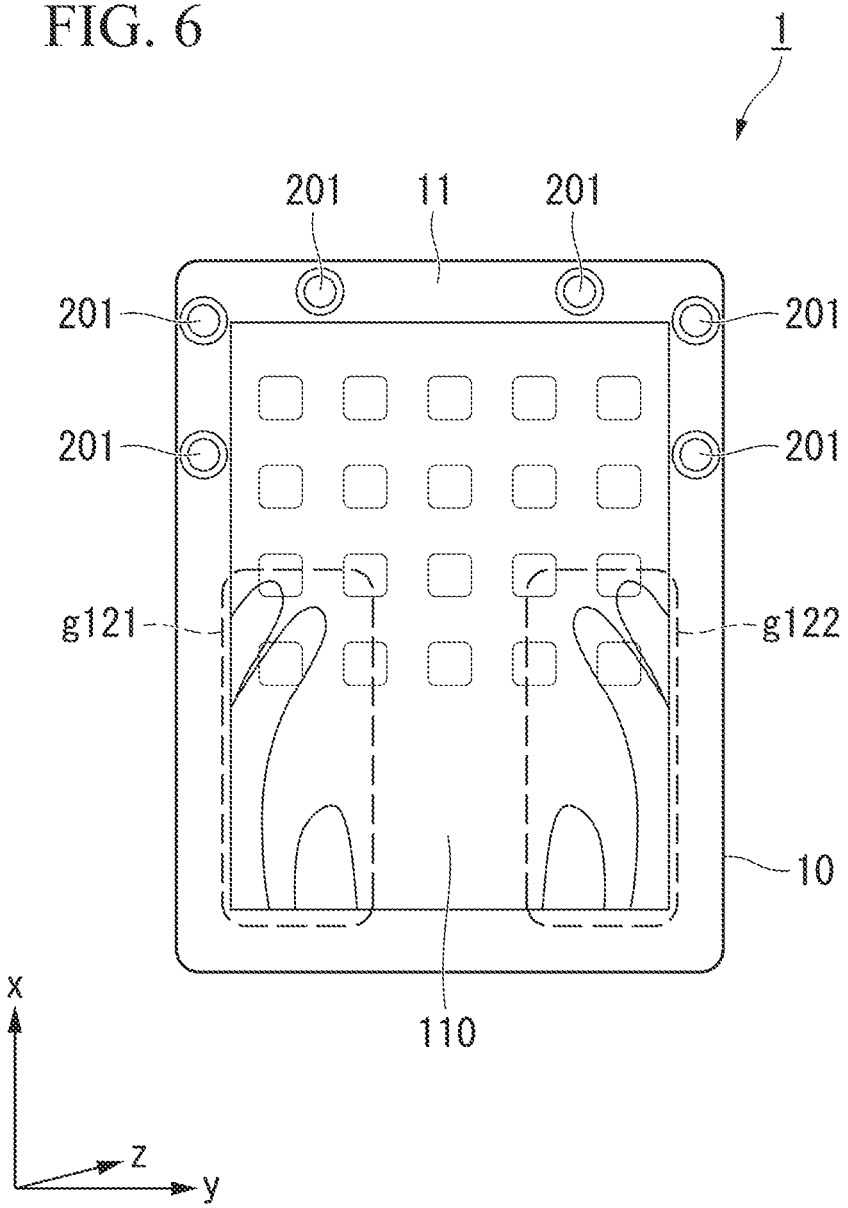
FIG. 6 is a diagram for explaining an example of an image indicating a position to arrange the hands, which is displayed on the display section according to the first embodiment, when the display section is held vertically.

The determination section 103 starts determination of a direction of the sound source localization device 10 according to activation information input from the application control section 112, based on the rotation angle information or the angular speed input from the acquisition section 102. The determination section 103 may perform determination at all times, while the sound source localization device 10 is activated. The determination section 103 outputs a determined determination result to the first image generation section 105. The direction of the sound source localization device 10 indicates a direction in which the sound source localization device 10 is held laterally or vertically by a user. The laterally held direction is, as shown in FIG. 2, a direction in which the longitudinal direction is along the y-axis direction and the transverse direction is along the x-axis direction, and the user holds the frame in the transverse direction. Moreover, the vertically held direction is, as shown in FIG. 6, a direction in which the longitudinal direction is along the x-axis direction and the transverse direction is along the y-axis direction, and the user holds the frame in the longitudinal direction. The determination result includes information indicating the vertically held direction, or information indicating the laterally held direction. FIG. 6 will be described later.

The storage section 104 stores information indicating the shape of human fingers or the shape of human hands.

The first image generation section 105 generates an image (a first image) indicating a position to arrange the hands, to be displayed on the display section 110, based on the determination result input from the determination section 103, by using the information indicating the shape of the human fingers or the shape of the hands stored in the storage section 104. The image indicating the position to arrange the hands will be described later. The first image generation section 105 outputs the generated image indicating the position to arrange the hands, to the image synthesis section 109.

The sound signal acquisition section 106 acquires n sound signals recorded by n sound pickup devices 201 of the sound pickup section 20. The sound signal acquisition section 106 generates an input signal in a frequency domain by performing Fourier transform for each frame with respect to the acquired n sound signals in a time domain.

The sound signal acquisition section 106 outputs the Fourier transformed n sound signals to the sound source localization section 107.

The sound source localization section 107 starts estimation of an azimuth angle of the sound source Sp (also referred to as specifies the direction of the sound source or performs sound source localization) according to the activation information input from the application control section 112, based on the sound signal input from the sound signal acquisition section 106. The sound source localization section 107 may perform estimation of the azimuth angle of the sound source Sp at all times, while the sound source localization device 10 is activated or the sound pickup section 20 is connected thereto. The sound source localization section 107 outputs azimuth angle information indicating the estimated azimuth angle, to the second image generation section 108. Moreover, the sound source localization section 107 outputs the input sound signal and the azimuth angle information, to the sound source separation section 124. The azimuth angle to be estimated by the sound source localization section 107 is a direction based on a direction from a barycentric point of the position of the n sound pickup devices 201 provided in the sound pickup section 20 toward a preset one sound pickup device 201, of the n sound pickup devices 201, for example, in a plane where the n sound pickup devices 201 are arranged. The sound source localization section 107 estimates the azimuth angle by using, for example, a MUSIC (Multiple Signal Classification) method. For the estimation of the azimuth angle, other sound source direction estimation methods such as a Beam Forming method, a WDS-BF (Weighted Delay and Sum Beam Forming) method, a MUSIC (GSVD-MUSIC; Generalized Singular Value Decomposition-Multiple Signal Classification) method using a generalized singular value expansion, may be used.

The second image generation section 108 generates an image (a second image) indicating a direction of the sound source, based on the azimuth angle information input from the sound source localization section 107, and outputs the generated image indicating the direction of the sound source to the image synthesis section 109.

The image synthesis section 109 synthesizes the image indicating the position to arrange the hands, input from the first image generation section 105, with an image displayed on the display section 110, and displays the synthesized image on the display section 110. Moreover, the image synthesis section 109 synthesizes the image indicating the direction of the sound source input from the second image generation section 108, with the image displayed on the display section 110, and displays the synthesized image on the display section 110. Here, the image displayed on the display section 110 is an image after activation of the application for performing sound source localization, an image in which an icon of the application is displayed on the display section 110, or the like.

The display section 110 is, for example, a liquid crystal display panel, an organic EL (ElectroLuminescence) display panel, or the like. The display section 110 displays images synthesized by the image synthesis section 109.

The operating section 111 detects an operation input from the user, and outputs operation information based on a detection result, to the application control section 112. The operating section 111 is, for example, a touch panel sensor provided on the display section 110.

The application control section 112 activates the application of sound source localization (hereinafter, referred to as sound source localization application) according to the operation information input from the operating section 111. After activation of the sound source localization application, the application control section 112 generates an image after activation of the application, and outputs the generated image after activation of the application, to the image synthesis section 109. Moreover, after activation of the sound source localization application, the application control section 112 outputs activation information indicating that the application has been activated, to the determination section 103 and the sound source localization section 107.

The sound source separation section 124 acquires the n channel sound signals output by the sound source localization section 107, and separates the acquired n channel sound signals into a sound signal for each speaker by using, for example, a GHDSS (Geometric High-order Decorrelation-based Source Separation) method. Moreover, the sound source separation section 124 may perform a sound source separation process by using, for example, an independent component analysis (ICA) method. The sound source separation section 124 outputs the separated sound signal for each speaker, to the voice output section 129. The sound source separation section 124 may separate the sound signals for each speaker after separating noise and the sound signal of the speaker from each other by using, for example, a transfer function stored in the own section. The sound source separation section 124 may calculate a sound feature amount, for example, for each of the n channel sound signals, and separate the sound signals into the sound signal for each person speaking, based on the calculated sound feature amount and the azimuth angle information input from the sound source localization section 107.

The voice output section 129 is a speaker. The voice output section 129 reproduces the sound signal input from the sound source separation section 124.

Next, a display procedure of the first image in the sound source localization device 10 is described.

Figure 3:
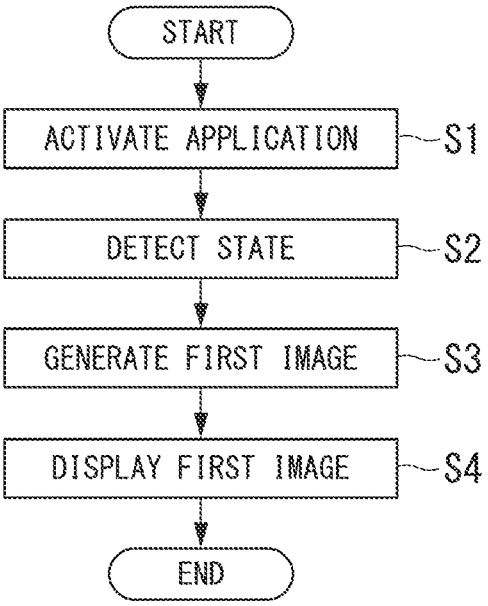
FIG. 3 is a flowchart of a display procedure of a first image in the sound source localization device according to the first embodiment.

FIG. 3 is a flowchart of a display procedure of the first image in the sound source localization device 10 according to the present embodiment.

(Step S1)

The user operates the operating section 111 to select an icon of the sound source localization application. The application control section 112 activates the sound source localization application according to the operation information input from the operating section 111. Upon activation of the sound source localization application, the application control section 112 outputs the activation information indicating that the application has been activated, to the determination section 103 and the sound source localization section 107.

(Step S2)

The determination section 103 starts determination of the direction of the sound source localization device 10 according to the activation information input from the application control section 112, based on the rotation angle information or the angular speed input from the acquisition section 102. Subsequently, the determination section 103 determines whether the sound source localization device 10 is held laterally or vertically.

(Step S3)

The first image generation section 105 uses the information indicating the shape of the human fingers or the shape of the hands stored in the storage section 104 to generate the image (the first image) indicating the position to arrange the hands, which is displayed on the display section 110, based on the determination result input from the determination section 103.

(Step S4)

The image synthesis section 109 synthesizes the image indicating the position to arrange the hands input from the first image generation section 105, with the image displayed on the display section 110, and displays the synthesized image on the display section 110.

Then, the display procedure of the first image in the sound source localization device 10 finishes.

Next, an example of a sound source localization process performed by the sound source localization section 107 is described.

For example, when the MUSIC method is to be used, the sound source localization section 107 estimates a spatial spectrum $P_M(\theta)$ by using the following equation (1).

$$P_M(\theta) = \frac{v^H(\theta)v(\theta)}{|v^H(\theta)E_n|^2} \tag{1}$$

In equation (1), $E_n$ is $[e_{N+1}, \ldots e_M]$. Moreover, N is the number of sound sources, M is the number of sound pickup devices. Furthermore, $[e_{N+1}, \ldots e_M]$ is a proper vector. Superscript H represents the conjugate transpose.

Here, when a steering vector $v(\theta)$ in the case where a virtual sound source is in a $\theta$ direction, agrees with a steering vector $a_i$ of the sound source ($v(\theta)=a_i$), it is expressed as in the following equation (2).

$$v^H(\theta)e_{N+1} = \ldots = v^H(\theta)e_M = 0 \tag{2}$$

According to equation (2), $P_M(\theta)$ has a peak in $v(\theta)=a_i$. The angle to be the peak is the azimuth angle of the sound source.

Next, an example of the image to be displayed on the display section 110 is described.

At first, an example of a screen at the time of activation of the sound source localization application to be displayed on the display section 110, is described.

Figure 4:
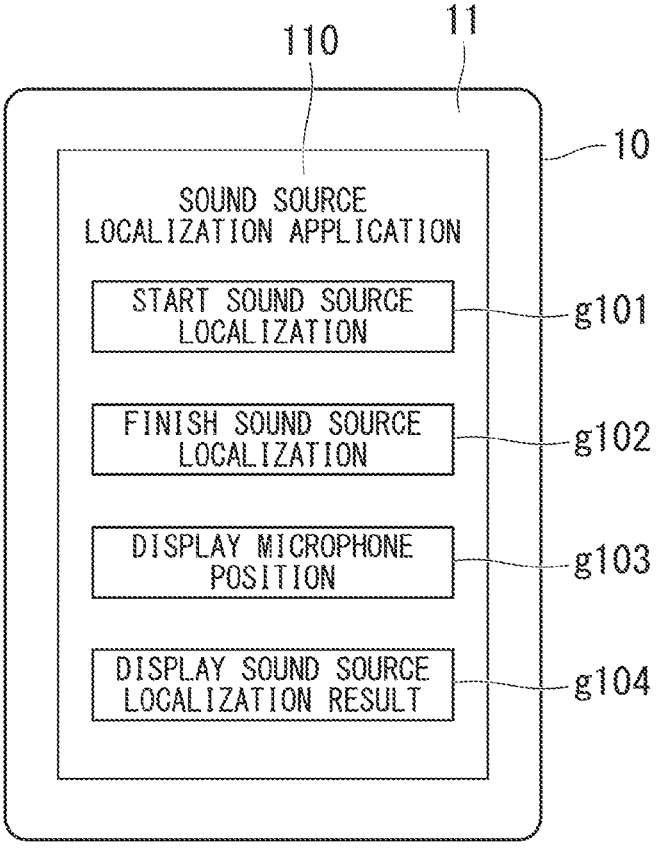
FIG. 4 is a diagram for explaining an example of a screen at the time of startup of a sound source localization application, which is displayed on a display section, according to the first embodiment.

FIG. 4 is a diagram for explaining an example of the screen at the time of activation of the sound source localization application to be displayed on the display section 110 according to the present embodiment. In the example shown in FIG. 4, an image g101 of a "sound source localization start" button, an image g102 of a "sound source localization end" button, an image g103 of a "microphone position display" button, and an image g104 of a "sound source localization result display" button are displayed on the display section 110.

The image g101 of the "sound source localization start" button is an image of a button to start the sound source localization process. The image g102 of the "sound source localization end" button is an image of a button to finish the sound source localization process. The image g103 of the "microphone position display" button is an image of a button to display the position of the sound pickup device 201 incorporated in the sound source localization device 10. The image g104 of the "sound source localization result display" button is an image of a button to display a result of the sound source localization process. When the "sound source localization result display" button is selected by the user, the sound source separation section 124 may output the separated sound signal to the voice output section 129.

In the example shown in FIG. 4, an example in which upon activation of the sound source localization application, the image g101 of the "sound source localization start" button and the image g102 of the "sound source localization end" button are displayed on the display section 110 has been shown. However, the sound source localization process is not limited thereto. For example, the image g101 of the "sound source localization start" button and the image g102 of the "sound source localization end" button need not be displayed on the display section 110, by starting the sound source localization process when the sound source localization application is activated, and finishing the sound source localization process when the sound source localization application is finished.

Next an example of the image (the first image) indicating the position to arrange the hands, which is displayed on the display section 110, is described with reference to FIG. 5 and FIG. 6.

Figure 5:
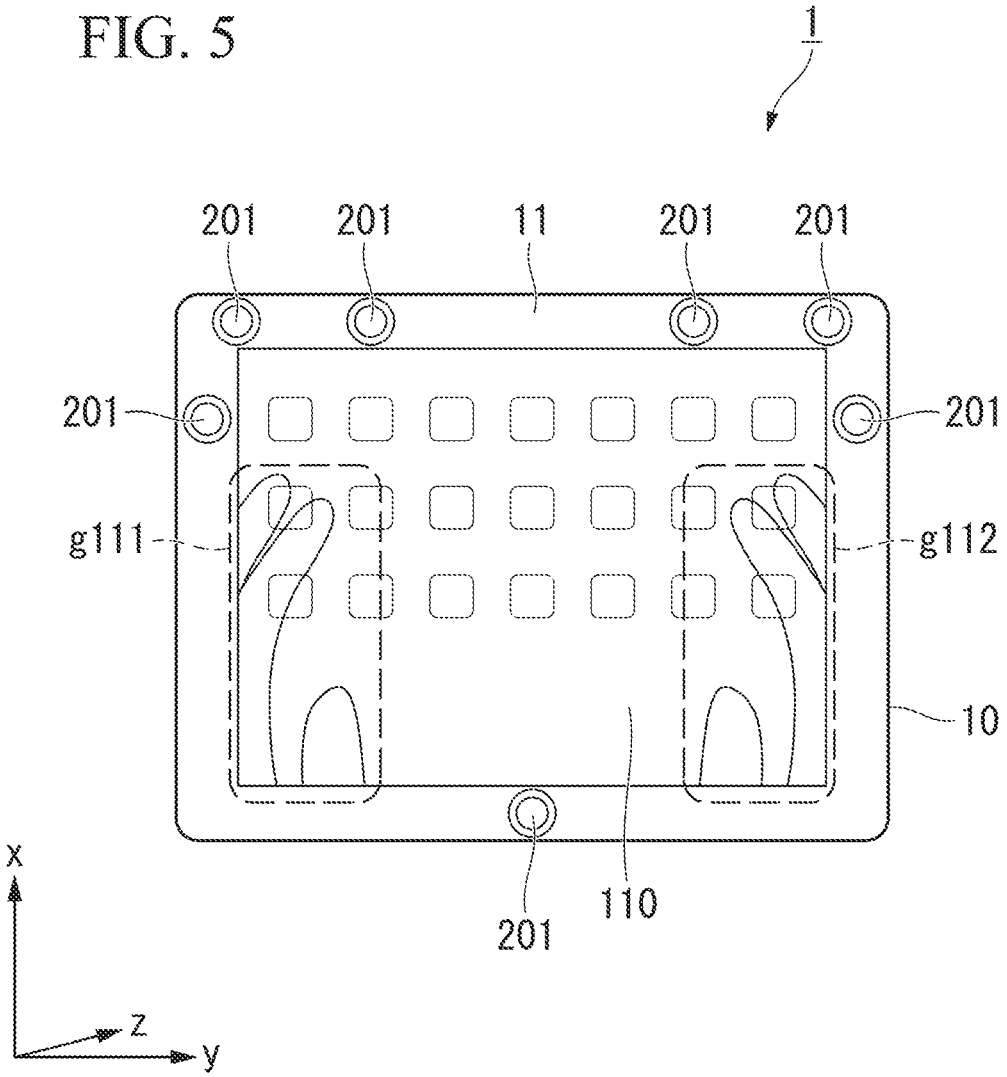
FIG. 5 is a diagram for explaining an example of an image indicating a position to arrange hands, which is displayed on the display section according to the first embodiment, when the display section is held laterally.

FIG. 5 is a diagram for explaining an example of the image (the first image) indicating the position to arrange the hands, which is displayed on the display section 110 according to the present embodiment, when the display section is laterally held. In FIG. 5, the images gill and g112 indicating the positions to arrange the user's hands in order to hold the sound source localization device 10, are displayed on the display section 110. The image gill is an image indicating a position to arrange the left hand, and the image g112 is an image indicating a position to arrange the right hand.

FIG. 6 is a diagram for explaining an example of the image (the first image) indicating the position to arrange the hands, which is displayed on the display section 110 according to the present embodiment, when the display section is vertically held. In FIG. 6, the images g121 and g122 indicating the positions to arrange the user's hands in order to hold the sound source localization device 10, are displayed on the display section 110. The image g121 is an image indicating a position to arrange the left hand, and the image g122 is an image indicating a position to arrange the right hand.

In the examples shown in FIG. 5 and FIG. 6, the example of the image of the shape of the hands has been described as the first image. However, the image is not limited thereto. For example, an oval image, a square image, or the like may be used so long as the image indicates the position to arrange the hands.

Moreover, as shown in FIG. 5 and FIG. 6, the first image may be an image of an outline of the hands. Consequently, an area blocking the image or the like of the sound source localization application displayed on the display section 110 can be reduced.

Furthermore, the first image may be displayed, overlapped on the image of the sound source localization application displayed on the display section 110, as a translucent image. Consequently, it can be prevented that the image or the like of the sound source localization application displayed on the display section 110 is blocked.

As described above, in a sound source localization device that specifies the direction of the sound source based on the sound signals recorded by at least two sound pickup devices, of the sound pickup section 20 having the plurality of sound pickup devices 201 that record the sound signal, the sound source localization device 10 according to the present embodiment includes a notification device that notifies information based on the arrangement of the sound pickup devices (for example, the first image generation section 105, the image synthesis section 109, and the display section 110).

According to the configuration, the user can arrange the hands at positions where the sound pickup devices are not covered, by confirming the notified information. As a result, because the sound pickup devices are not covered with the user's hands, the sound source localization device 10 according to the present embodiment can improve the accuracy of sound source localization by using the sound signals recorded by the plurality of sound pickup devices.

Moreover, in the sound source localization device 10 according to the present embodiment, the notification device (for example, the first image generation section 105, the image synthesis section 109, and the display section 110) notifies the information indicating the position to arrange the user's hands on the display section 110.

According to the configuration, because the sound source localization device 10 according to the present embodiment displays the image indicating the position to arrange the hands on the display section 110, the user can arrange the hands at the position where the sound pickup devices 201 are not covered, by confirming the notified information. As a result, because the sound pickup devices 201 are not covered with the user's hands, the sound source localization device 10 according to the present embodiment can improve the accuracy of sound source localization.

Moreover, the sound source localization device 10 according to the present embodiment also includes the sensor 101 that detects the direction of the sound source localization device 10 set by the user, and the notification device (for example, the first image generation section 105, the image synthesis section 109, and the display section 110) notifies the information based on the arrangement of the sound pickup devices 201 according to the direction detected by the sensor.

According to the configuration, the sound source localization device 10 according to the present embodiment can notify the information indicating the position to arrange the hands, according to the direction in which the user is holding the sound source localization device 10. Consequently, the user can arrange the hands at the position where the sound pickup devices 201 are not covered, by confirming the notified information regardless of the holding direction. As a result, because the sound pickup devices 201 are not covered with the user's hands, the sound source localization device 10 according to the present embodiment can improve the accuracy of sound source localization.

As shown in FIG. 5 and FIG. 6, the sound pickup devices 201 are arranged on a frame 11. If the sound source localization device 10 is exclusive to lateral holding or vertical holding, the sound pickup devices 201 may be arranged by avoiding a position where it is assumed that the user generally arranges the hands at the time of holding the sound source localization device 10 vertically, or a position where it is assumed that the user generally arranges the hands at the time of holding the sound source localization device 10 laterally.

Moreover, in the present embodiment, the example in which the first image is displayed on the display section 110 has been described. However, the present invention is not limited thereto. For example, when a liquid crystal panel (not shown) is attached to the frame 11, the image synthesis section 109 may display the first image on the frame 11. In this case, because the image to be displayed on the frame 11 is the image of the outline of the hands or the shape of the hands, the liquid crystal panel attached to the frame 11 may be a monochrome liquid crystal panel. Furthermore, the liquid crystal panel attached to the frame 11 need not include a backlight.

That is to say, in the sound source localization device 10 according to the present embodiment, the notification device (for example, the first image generation section 105, the image synthesis section 109, and the display section 110) notifies the information indicating the position to arrange the user's hands on the frame 11 of the display section 110.

Consequently, the sound source localization device 10 of the present embodiment can display the image indicating the position to arrange the hands on the frame 11, without blocking the image displayed on the display section 110.

Figure 7:
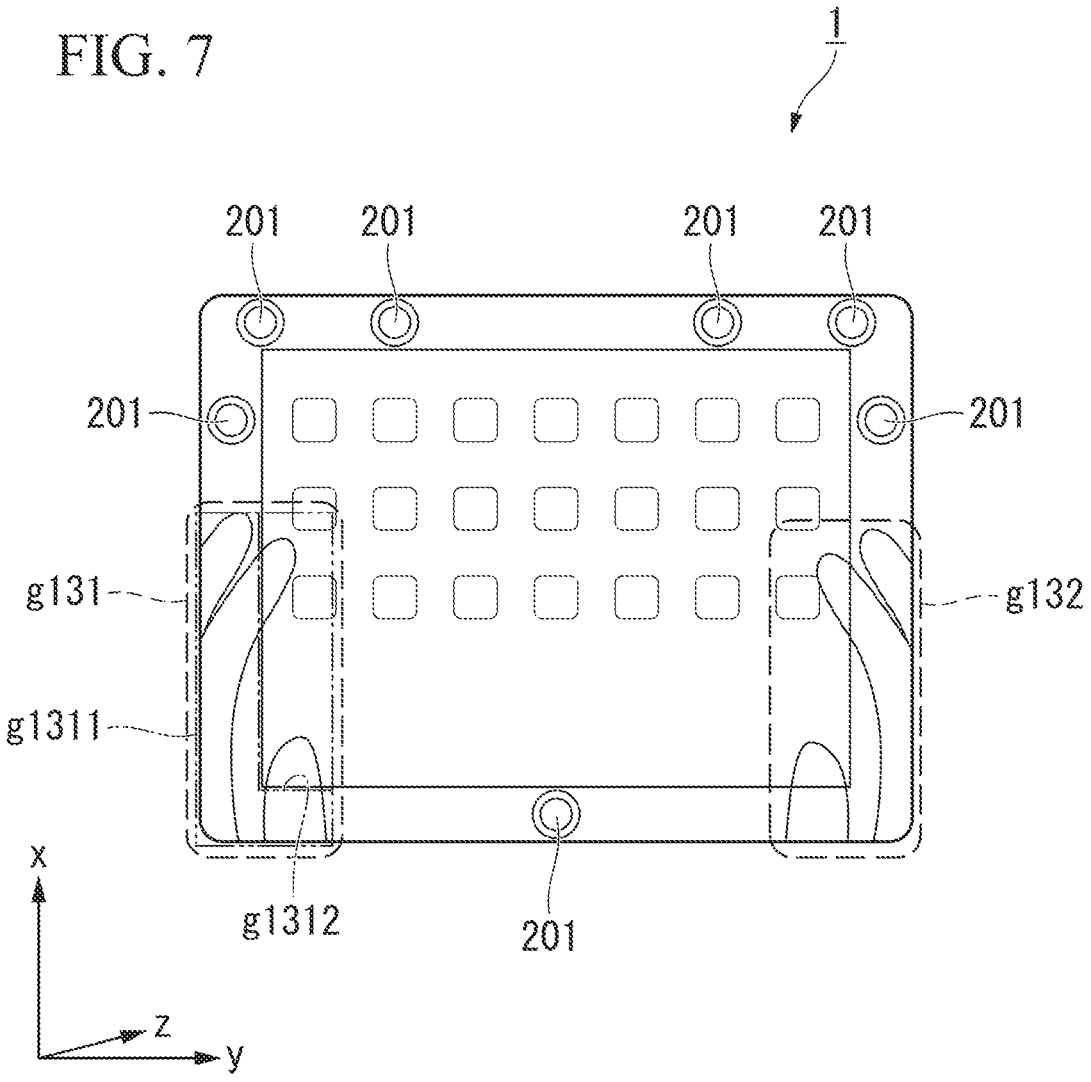
FIG. 7 is a diagram for explaining an example of an image indicating a position to arrange hands, which is displayed on a frame and the display section according to the first embodiment.

As shown in FIG. 7, the image of the outline of the hands or the shape of the hands may be continuously displayed on both the frame 11 and the display section 110.

FIG. 7 is a diagram for explaining an example of the image (the first image) indicating the position to arrange the hands, which is displayed on the frame 11 and the display section 110 according to the present embodiment. In FIG. 7, images g131 and g132 indicating the position to arrange the user's hands in order to hold the sound source localization device 10, are displayed on the frame 11 and the display section 110. The image g131 is an image indicating the position to arrange the left hand, and the image g132 is an image indicating the position to arrange the right hand.

Moreover, the image of an area indicated by reference symbol g1311 is an image indicating the position to arrange the hand to be displayed on the frame 11, and the image of an area indicated by reference symbol g1312 is an image indicating the position to arrange the hand to be displayed on the display section 110.

In the example shown in FIG. 7, the example in which the image indicating the position to arrange the hand is displayed on both the frame 11 and the display section 110 is illustrated. However, the image indicating the position to arrange the hand may be displayed only on the frame 11.

Moreover, in the present embodiment, an example in which the image indicating the position to arrange the hands is displayed on the frame 11 or the display section 110 has been described. However, the present invention is not limited thereto. The image indicating the position to arrange the hands may be originally printed on the frame 11 or the display section 110.

That is to say, in the sound source localization device 10 according to the present embodiment, as the notification device, an image indicating the position to arrange the hands on the frame 11 of the display section 110 is printed.

Consequently, in the sound source localization device 10 of the present embodiment, the user can hold the sound source localization device 10 without blocking the sound pickup devices 201. As a result, the sound source localization device 10 according to the present embodiment can improve the accuracy of sound source localization, because the sound pickup devices 201 are not blocked.

Furthermore, if an attachment to be attached to the sound source localization device 10 includes a liquid crystal panel (not shown), the image synthesis section 109 may display the first image on the attachment, as the image indicating the position to arrange the hands. In this case, because the image to be displayed on the attachment is the image of the outline of the hand or the shape of the hand, the liquid crystal panel attached to the attachment may be a monochrome liquid crystal panel.

The attachment is, for example, a cover, a case, or a bumper.

That is to say, in the sound source localization device 10 according to the present embodiment, the notification device (for example, the first image generation section 105, the image synthesis section 109, and the display section 110) notifies the position to arrange the user's hands on an attachment 30 (for example, the cover, the case, or the bumper) to be attached to the sound source localization device 10.

Consequently, the sound source localization device 10 according to the present embodiment can display the image indicating the position to arrange the hands on the frame 11, without blocking the image displayed on the display section 110.

In this case, the sound source localization device 10 includes a communication section (not shown), and the attachment includes a power source, a communication section, a control section, and a liquid crystal panel (not shown). For example, the image synthesis section 109 of the sound source localization device 10 transmits the first image to the attachment via the communication section. The control section of the attachment receives the first image via the communication section, and displays the received first image on the liquid crystal panel. The sound source localization device 10 and the attachment are connected by cable or by wireless.

In this manner, when the attachment is attached to the sound source localization device 10, the attachment may include the sound pickup section 20. In this case, the image indicating the position to arrange the hands may be originally printed on the attachment.

Figure 8:
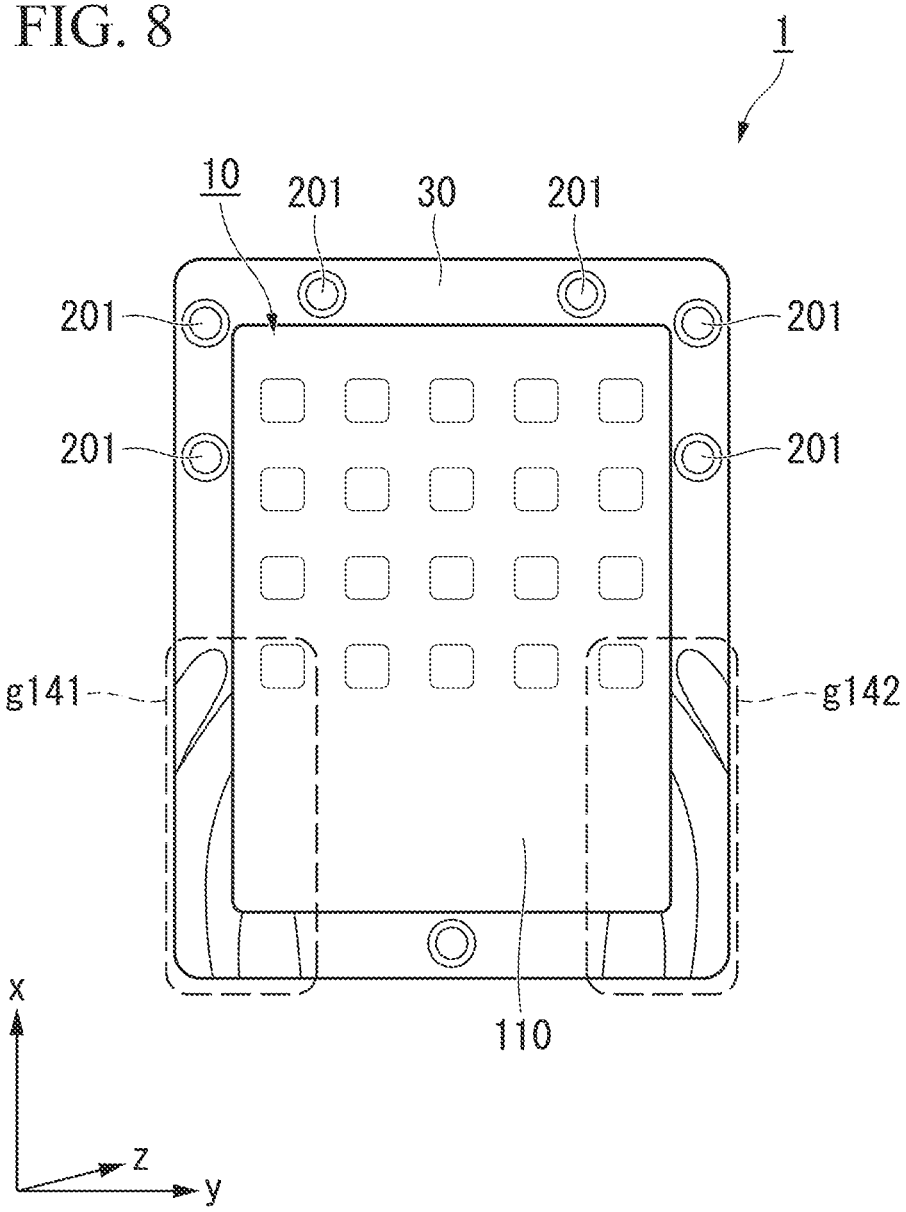
FIG. 8 is a diagram for explaining an example of an image indicating a position to arrange hands, which has been originally printed on an attachment according to the first embodiment.

FIG. 8 is a diagram for explaining an example of the image indicating the position to arrange the hands originally printed on the attachment 30 according to the present embodiment. In FIG. 8, an image g141 is an image indicating the position to arrange the left hand, which is originally printed on the attachment 30, and an image g142 is an image indicating the position to arrange the right hand, which is originally printed on the attachment 30.

As described above, in the sound source localization device 10 according to the present embodiment, in the notification device, the position to arrange the user's hands is printed on the attachment 30 (for example, the case, the cover, or the bumper) attached to the sound source localization device 10.

Consequently, the sound source localization device 10 of the present embodiment can display the image indicating the position to arrange the hands on the attachment 30, without blocking the image displayed on the display section 110.

When the attachment 30 is attached to the sound source localization device 10, the position where the sound pickup devices 201 are attached may be originally printed on the attachment 30.

Moreover, when the "microphone position display" button shown in FIG. 4 is operated by the user, the application control section 112 may display the position where the sound pickup devices 201 are arranged, on the frame 11, the display section 110, or the attachment 30.

Figure 9:
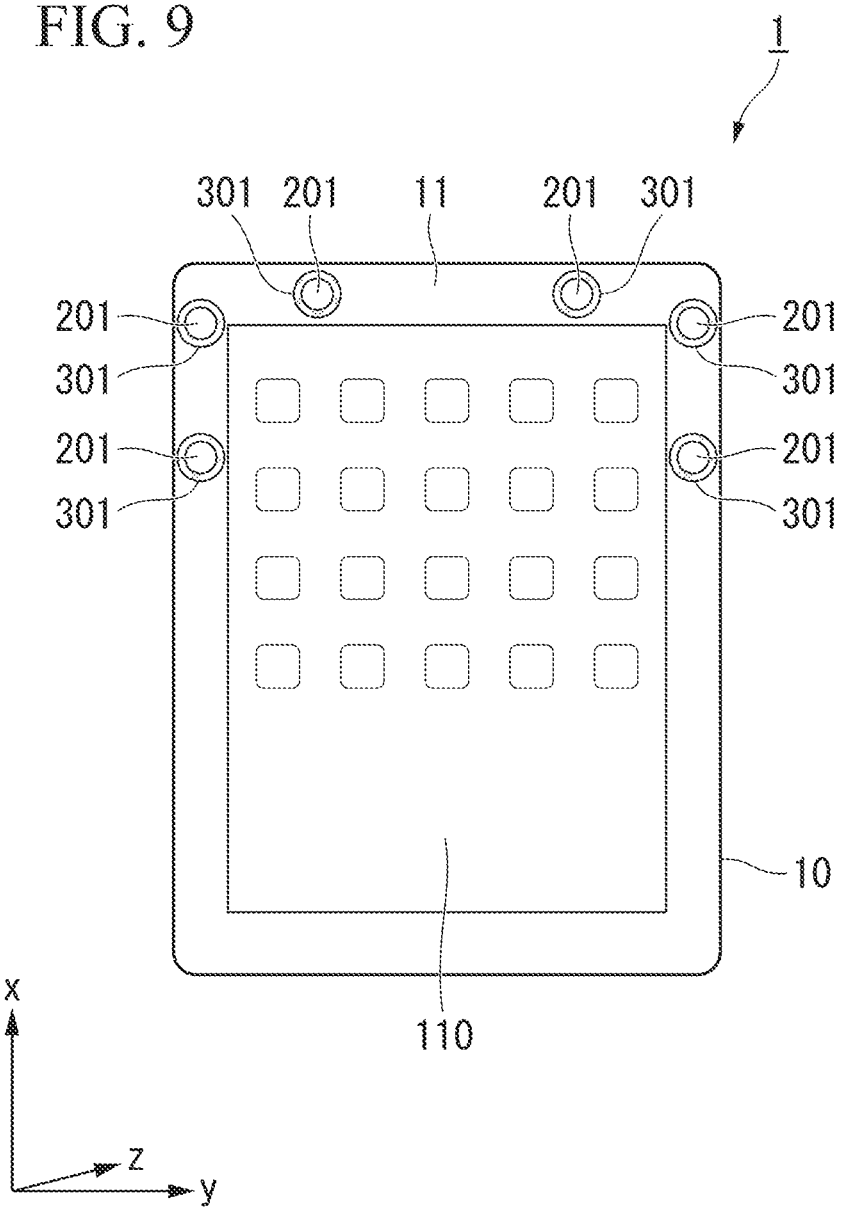
FIG. 9 is a diagram for explaining a notification example of a position where the sound pickup devices are arranged according to the first embodiment.

In this case, for example, as shown in FIG. 9, a light guide plate (not shown) and an LED (light-emitting diode) are arranged around the sound pickup devices 201 for each sound pickup device 201. The application control section 112 may notify the position where the sound pickup devices 201 are arranged, by lighting or flashing the LED as shown by reference symbol 301 in FIG. 9.

FIG. 9 is a diagram for explaining a notification example of the position where the sound pickup devices 201 are arranged according to the present embodiment. In the example shown in FIG. 9, the example in which the position where the sound pickup devices 201 are arranged is notified by lighting or flashing a peripheral part of the sound pickup devices 201 has been described. However, the position where the sound pickup devices 201 are arranged may be notified by lighting or flashing a part or the whole position of the sound pickup devices 201.

Furthermore, the application control section 112 may display the notification of the position where the sound pickup devices 201 are arranged, on the display section 110.

Figure 10:
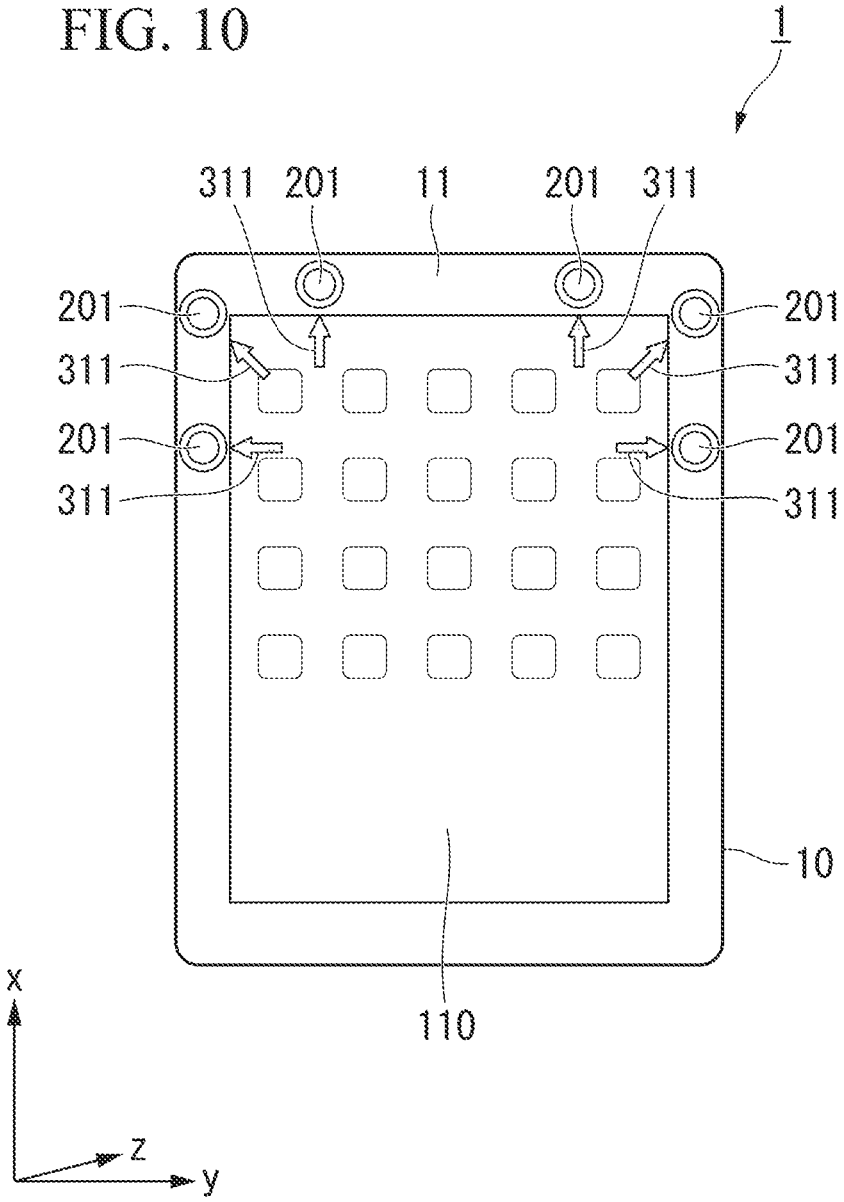
FIG. 10 is a diagram for explaining another example of notification of the position where the sound pickup devices are arranged, according to the first embodiment.

FIG. 10 is a diagram for explaining another example of notification of the position where the sound pickup devices 201 are arranged according to the present embodiment. In the example shown in FIG. 10, the positions of the sound pickup devices 201 are notified by displaying an image of an arrow 311 on the display section 110. It is desired that the image for notifying the positions of the sound pickup devices 201 is a different image from an image indicating the direction of the sound source Sp, which is a second image described later.

As described above, in the sound source localization device 10 according to the present embodiment, the notification device (for example, the first image generation section 105, the image synthesis section 109, the display section 110, and the application control section 112) notifies the position where the sound pickup devices 201 are arranged.

Consequently, the sound source localization device 10 according to the present embodiment can notify the user of the positions of the sound pickup devices 201. Because the user can know the positions of the sound pickup devices 201 by the notified image or lighting or flashing of the LED, the user can hold the sound source localization device 10, avoiding the positions where the sound pickup devices 201 are arranged. As a result, according to the present embodiment, a situation where the sound pickup devices 201 are blocked can be prevented, and hence the accuracy of sound source localization can be improved.

Furthermore, in the embodiment, the notification device is at least one device of; a device that notifies the information indicating the position to arrange the user's hands to the display section 110, a device that notifies the information indicating the position to arrange the user's hands to the frame of the display section 110, a device that notifies the position to arrange the user's hands to the attachment 30 attached to the sound source localization device 10, a device in which the position to arrange the hands is printed on the frame 11 of the display section 110, a device in which the position to arrange the hands is printed on the attachment 30, and a device that notifies the positions where the sound pickup devices 201 are arranged.

Modification Example

In the present embodiment, the tablet terminal has been described as an example of the sound source localization device 10. However, the sound source localization device 10 may be, for example, a smartphone.

When the width of the sound source localization device 10 is, for example, within 8 cm, the user may hold a sound source localization device 10A with one hand of the right hand or the left hand. In this case, as shown in FIG. 11, the image (the first image) indicating the position to arrange the hand, to be displayed on the display section 110, may be an image of an outline or an external shape of one hand.

Figure 11:
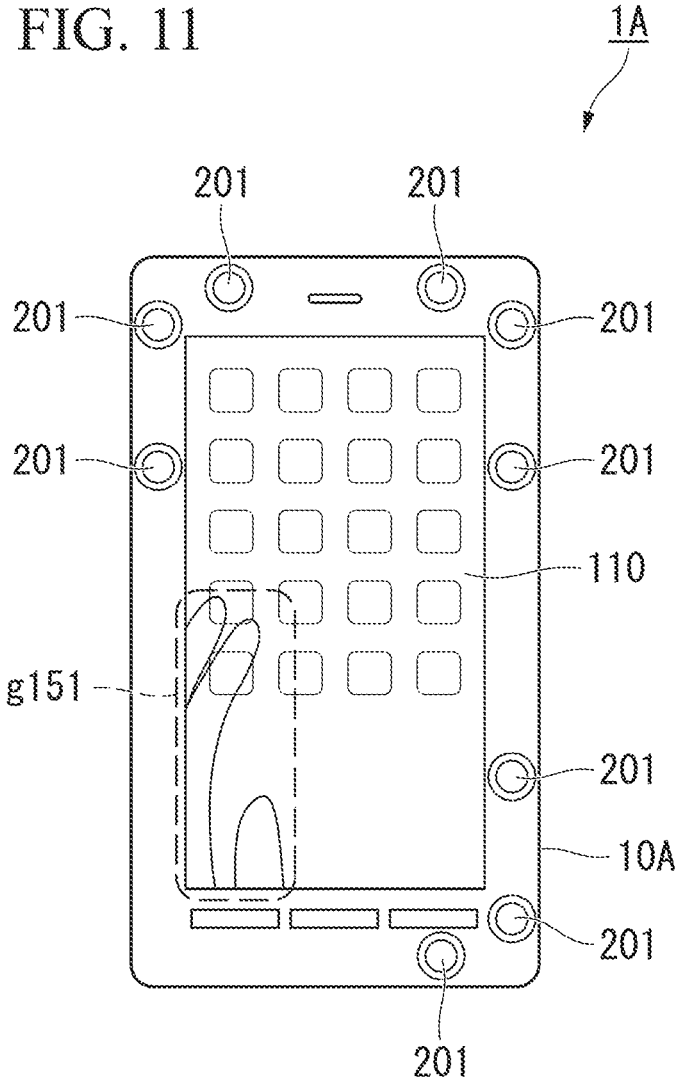
FIG. 11 is a diagram for explaining an example of an image indicating a position to arrange the hand, which is displayed on the display section according to the first embodiment, when the display section is held vertically.

FIG. 11 is a diagram for explaining an example of the image (the first image) indicating the position to arrange the hand to be displayed on the display section 110, in the vertically holding case according to the present embodiment. In the example shown in FIG. 11, the sound source localization device 10A is, for example, a smartphone, and the size of a screen of the display section 110 is, for example, 5 inches.

In FIG. 11, an image g151 indicating the position to arrange the user's hand in order to hold the sound source localization device 10A is displayed on the display section 110. The image g151 is an image indicating the position to arrange the left hand.

As the image (the first image) indicating the position to arrange the hand, to be displayed on the display section 110, for example, in the sound source localization application, it is selected whether to display the image of the right hand, display the image of the left hand, or display the image of both hands. The application control section 112 outputs the selected information to the determination section 103. The determination section 103 outputs the selected information input from the application control section 112, to the first image generation section 105. The first image generation section 105 may generate the first image based on the selected information input from the determination section 103.

Moreover, also in the sound source localization device 10A, when the liquid crystal panel (not shown) is incorporated in the frame 11, the image synthesis section 109 may display the first image on the frame 11. Furthermore, in the image synthesis section 109, the image indicating the position to arrange the hand may be originally printed on at least one of the frame 11 and the attachment 30. Furthermore, when the attachment 30 includes the liquid crystal panel, the image synthesis section 109 may display the image indicating the position to arrange the hand, on the attachment 30.

Furthermore, in the present embodiment, the example in which the image indicating the outline or the shape of the hands is originally stored in the storage section 104 has been described. However, the present invention is not limited thereto. For example, when the user holds the sound source localization device 10 or the sound source localization device 10A before the sound source localization process is performed, for example, the application control section 112 detects an area, in which a predetermined area or more of the user's hand comes in contact with the operating section 111, as an area where the user's hand is placed. Then, the application control section 112 generates an image indicating the outline or the shape of the hand for each user based on the detected result, and stores the generated image indicating the outline or the shape of the hand in the storage section 104.

Second Embodiment

In the first embodiment, the example in which the sound pickup devices 201 are provided on the display section 110 side of the sound source localization device 10 or the sound source localization device 10A has been described. However, in the present embodiment, an example in which a sound source localization device 10B includes sound pickup devices on a display section side and a bottom surface side opposite to the display section will be described.

At first, an example in which the sound source localization device 10B uses the sound pickup devices on one side, of the sound pickup devices on the display section side and the sound pickup devices on the bottom surface side, to estimate (also referred to as specify) the direction of the sound source, and performs a sound source separation process, will be described.

Figure 12:
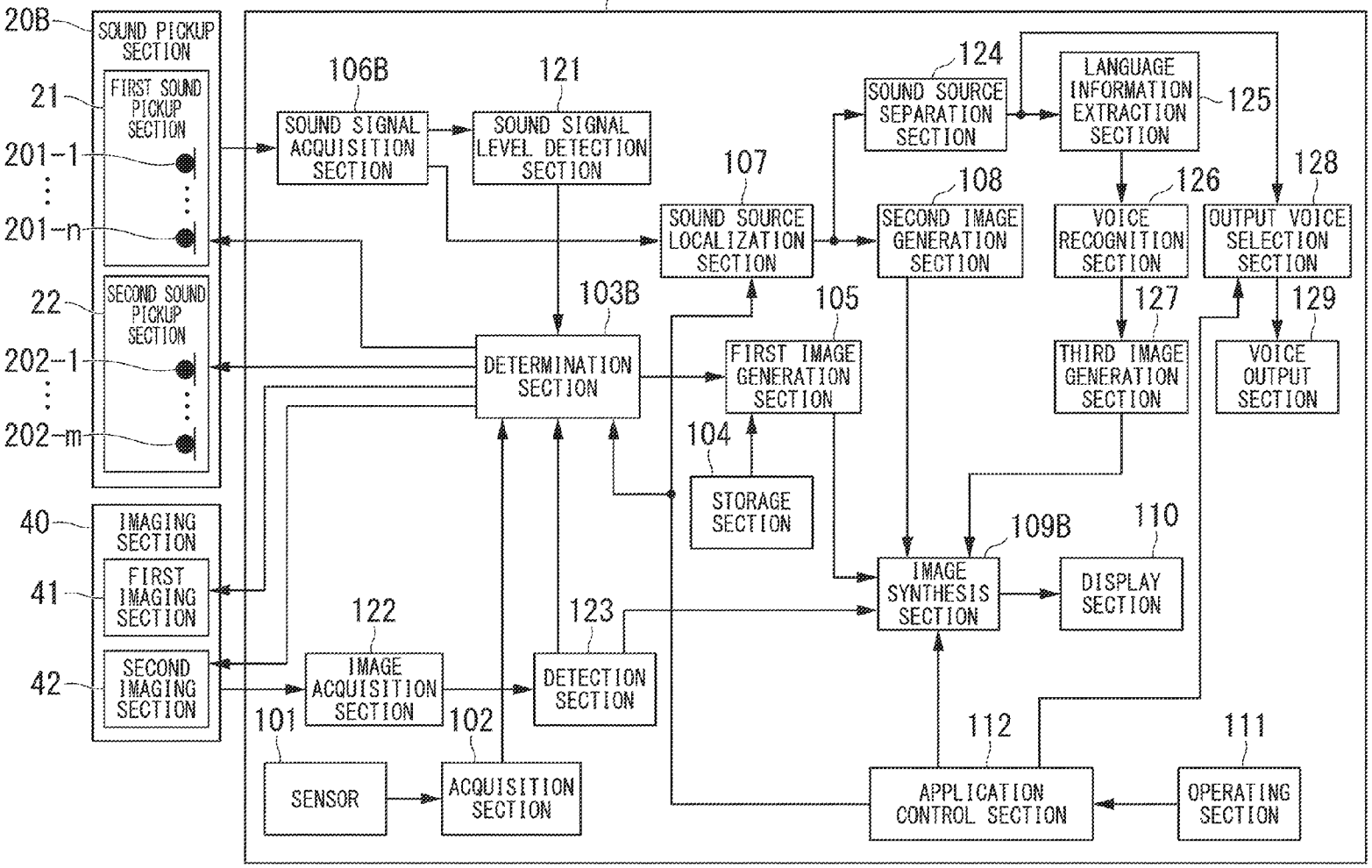
FIG. 12 is a block diagram showing a configuration of a sound processing system according to a second embodiment.

FIG. 12 is a block diagram showing a configuration of a sound processing system 1B according to the present embodiment. As shown in FIG. 12, the sound processing system 1B includes a sound source localization device 10B, a sound pickup section 20B, and an imaging section 40. In the explanation below, it is assumed that the display section side is a front side, and the bottom side opposite to the display section is a back side.

The sound pickup device 20B further includes m sound pickup devices 202-1 to **202-*m* in addition to the n sound pickup devices 201. When any of the sound pickup devices 202-1 to 202-*m* (m is an integer equal to or larger than 2) is not specified, the sound pickup device is noted as sound pickup device 202**. The n and m can be the same value.

The sound pickup section 20B forms a first microphone array by the n sound pickup devices 201, or forms a second microphone array by the m sound pickup devices 202. The respective sound pickup devices 201-1 to **201-*n* and the respective sound pickup devices 202-1 to 202-*m* output collected sound signals to the sound source localization device 10B. The sound pickup section 20B may transmit recorded n-channel or m-channel sound signals by wireless or by cable. Moreover, the sound pickup section 20B may be attached detachably to the sound source localization device 10B, or may be incorporated in the sound source localization device 10B. In an example described below, an example in which the sound pickup section 20B is incorporated in the sound source localization device 10B will be described. In the explanation below, the sound pickup device 201 is also referred to as a front microphone, and the sound pickup device 202** is also referred to as a back microphone.

The imaging section 40 includes a first imaging section 41 and a second imaging section 42. The imaging section 40 outputs a captured image to the sound source localization device 10B. The imaging section 40 may transmit the captured image by wireless or by cable. Moreover, the imaging section 40 may be attached detachably to the sound source localization device 10B, or may be incorporated in the sound source localization device 10B.

In an example below, an example in which the imaging section 40 is incorporated in the sound source localization device 10B will be described.

In the explanation below, the first imaging section 41 is also referred to as a front camera, and the second imaging section 42 is also referred to as a back camera.

The sound source localization device 10B is, for example, a mobile phone, a tablet terminal, a mobile game terminal, or a notebook personal computer, as in the sound source localization device 10. In the explanation below, an example in which the sound source localization device 10B is a tablet terminal will be described. The sound source localization device 10B notifies to a display section 110 of the sound source localization device 10B, or an attachment 30 (FIG. 8) attached to the sound source localization device 10B, information based on an arrangement of the sound pickup devices 201 and 202. Moreover, the sound source localization device 10B performs sound source localization based on a sound signal input from the sound pickup section 20B. Furthermore, the sound source localization device 10B decides whether to perform sound source localization by using the sound pickup devices 201 (front microphones) or the sound pickup devices 202 (back microphones), based on image information imaged by the first imaging section 41 and the second imaging section 42.

Next, the arrangement of the sound pickup devices 201 and 202 is described.

Figure 13:
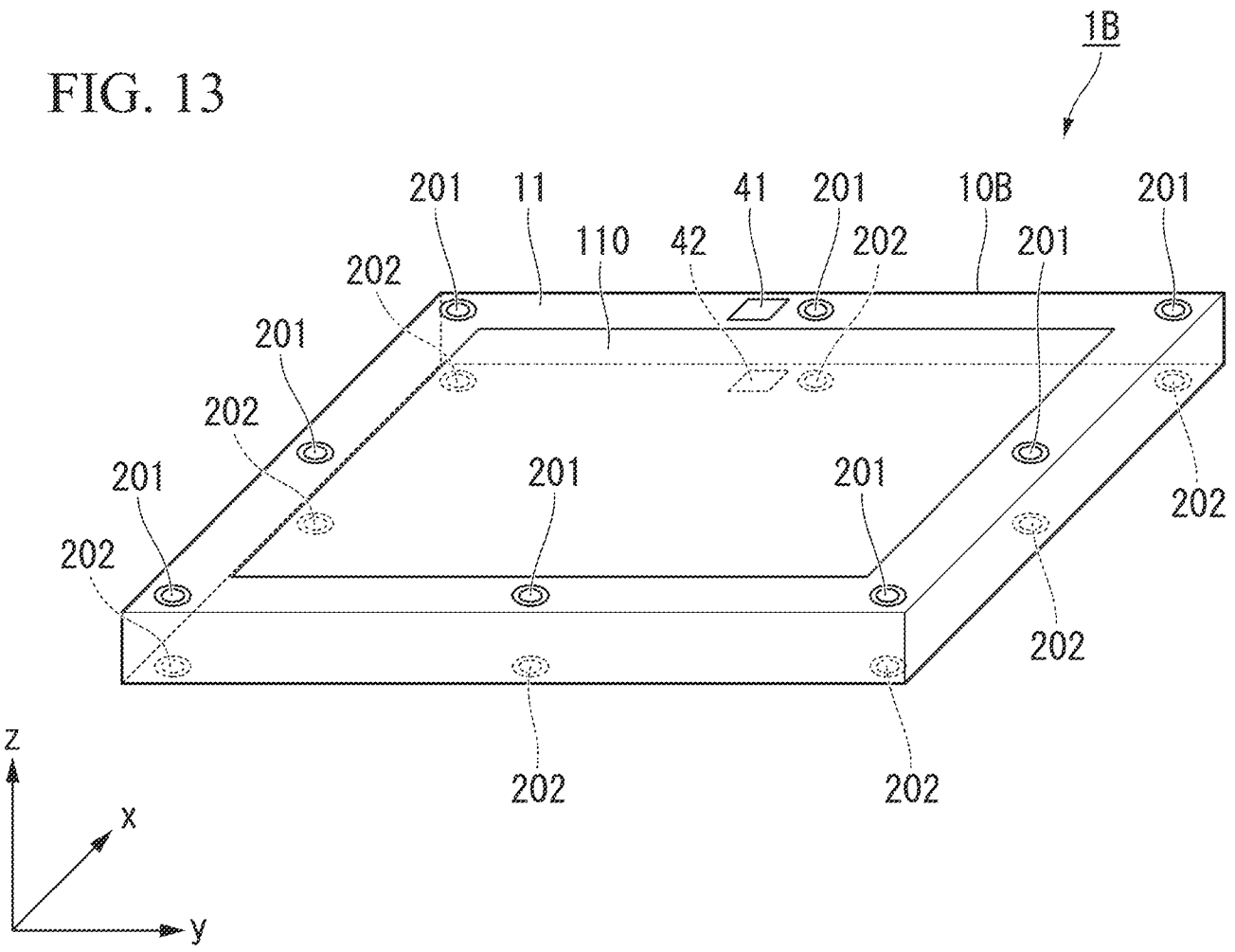
FIG. 13 is a diagram for explaining an arrangement of sound pickup devices 201 and 202 according to the second embodiment.

FIG. 13 is a diagram for explaining the arrangement of the sound pickup devices 201 and 202 according to the present embodiment. In FIG. 13, it is assumed that the transverse direction of the sound source localization device 10B is the x-axis direction, the longitudinal direction is the y-axis direction, and the thickness direction is the z-axis direction. In the example shown in FIG. 13, the sound pickup section 20B includes the eight sound pickup devices 201 on the front side, and includes the eight sound pickup devices 202 on the back side. The eight sound pickup devices 201 are arranged on the front side of the sound source localization device 10B in the xy plane, and attached to a substantially peripheral part 11 (also referred to as frame) of the display section 110 of the sound source localization device 10B. The eight sound pickup devices 202 are arranged on the back side of the sound source localization device 10B in the xy plane, and attached to the substantially peripheral part of the sound source localization device 10B. The number and arrangement of the sound pickup devices 201 and 202 shown in FIG. 13 is an example only, and the number and arrangement of the sound pickup devices 201 and 202 are not limited thereto.

Next, returning to FIG. 12, a configuration of the sound source localization device 10B is described. The sound source localization device 10B includes; a sensor 101, an acquisition section 102, a determination section 103B, a storage section 104, a first image generation section 105, a sound signal acquisition section 106B, a sound source localization section 107, a second image generation section 108, an image synthesis section 109B, the display section 110, an operating section 111, an application control section 112, a sound signal level detection section 121, an image acquisition section 122, a detection section 123, a sound source separation section 124, a language information extraction section 125, a voice recognition section 126, a third image generation section 127, an output voice selection section 128, and a voice output section 129. Functional sections having the same functions as those of the sound source localization device 10 are denoted by the same reference symbols, and explanation thereof is omitted.

The sound signal acquisition section 106B acquires m sound signals recorded by m sound pickup devices 202 of the sound pickup section 20B. The sound signal acquisition section 106B generates an input signal in a frequency domain by performing Fourier transform for each frame with respect to the acquired m sound signals in the time domain. The sound signal acquisition section 106B outputs the Fourier transformed n or m sound signals in association with identification information for identifying the sound pickup devices 201 or the sound pickup devices 202, to the sound signal level detection section 121. The identification information includes information indicating that it is a sound signal recorded by a first sound pickup section 21, or information indicating that it is a sound signal recorded by a second sound pickup section 22.

The sound source localization section 107 outputs estimated azimuth angle information to the second image generation section 108, and outputs the azimuth angle information and the input sound signal to the sound source separation section 124.

The sound signal level detection section 121 detects respective signal levels of the n or m sound signals input from the sound pickup section 20B, and outputs information indicating the detected signal levels in association with the identification information of the sound pickup devices 201 or the sound pickup devices 202, to the determination section 103B.

The image acquisition section 122 acquires a captured image captured by the first imaging section 41 or a captured image captured by the second imaging section 42, and outputs the acquired captured image in association with the identification information for identifying the first imaging section 41 or the second imaging section 42, to the detection section 123.

The detection section 123 uses the captured image input from the image acquisition section 122 to detect, for example, brightness of the captured image, and detect the first imaging section 41 or the second imaging section 42 being used for imaging. Specifically, the user selects the imaging section to be used for imaging on an operation screen of the sound source localization application. For example, if the user selects the first imaging section 41, the application control section 112 outputs information indicating the selected imaging section to the determination section 103B. Then the determination section 103B controls the first imaging section 41 to the on state, and controls the unselected second imaging section 42 to an off state, according to the input information indicating the imaging section. Consequently, the detection section 123 can detect that the brightness of the captured image captured by the first imaging section 41 has a value equal to or higher than a predetermined value, and can detect that the brightness of the captured image captured by the second imaging section 42 has a value equal to or lower than the predetermined value.

The detection section 123 outputs the detected information indicating a detection result in association with the identification information of the first imaging section 41 or the second imaging section 42, to the determination section 103B.

The determination section 103B further performs the following process in addition to the process of the determination section 103. When the imaging section 40 is in the on state, the determination section 103B uses the information indicating the detection result input from the detection section 123 and the identification information of the first imaging section 41 or the second imaging section 42, to control the first sound pickup section 21 or the second sound pickup section 22 to the on state. Moreover, when the imaging section 40 is in the off state, the determination section 103B uses the information indicating the signal level input from the sound signal level detection section 121 and the identification information of the sound pickup devices 201 or the sound pickup devices 202, to control the first imaging section 41 or the second imaging section 42 to the on state.

The image synthesis section 109B further performs the following process in addition to the process of the image synthesis section 109.

The image synthesis section 109B overlaps the captured image input from the detection section 123 on the image displayed on the display section 110, and synthesizes these images. For example, the image synthesis section 109B overlaps the captured image input from the detection section 123 on the image displayed on the display section 110 in a translucent state, and synthesizes these images.

Alternatively, the image synthesis section 109B synthesizes the captured image input from the detection section 123 so as to be displayed on a partial area of the image displayed on the display section 110.

For example, when the "sound source localization result display" button shown in FIG. 4 is operated by the user, the image synthesis section 109B synthesizes a third image input from the third image generation section 127, with the captured image.

The sound source separation section 124 outputs the separated sound signals for each speaker and the azimuth angle information input from the sound source localization section 107, to the language information extraction section 125 and the output voice selection section 128.

The language information extraction section 125 detects a language for each speaker by a known method for each sound signal for each speaker input from the sound source separation section 124. The language information extraction section 125 outputs the information indicating the detected language for each speaker, the sound signals for each speaker input from the sound source separation section 124, and the azimuth information, to the voice recognition section 126. The language information extraction section 125 refers to, for example, a language database to detect the language for each speaker based on a reference result. The language database may be provided in the sound source localization device 10B, or may be connected via a wired or wireless network.

The voice recognition section 126 recognizes utterance content (for example, a text indicating a word or a sentence) by performing a voice recognition process with respect to the sound signal for each speaker input from the language information extraction section 125, based on the information indicating the language and the azimuth information for each speaker input from the language information extraction section 125. The voice recognition section 126 outputs the utterance content, the information indicating the speaker, and recognition data, to the third image generation section 127.

The third image generation section 127 generates the third image based on the utterance content input from the voice recognition section 126, the information indicating the speaker, and the recognition data, and outputs the generated third image to the image synthesis section 109B.

The output voice selection section 128 extracts detected utterance information input from the application control section 112, from the separated sound signal for each speaker input from the sound source separation section 124, and outputs the sound signal corresponding to the extracted utterance information, to the voice output section 129.

Next, an operation procedure of the sound source localization device 10B will be described.

Figure 14:
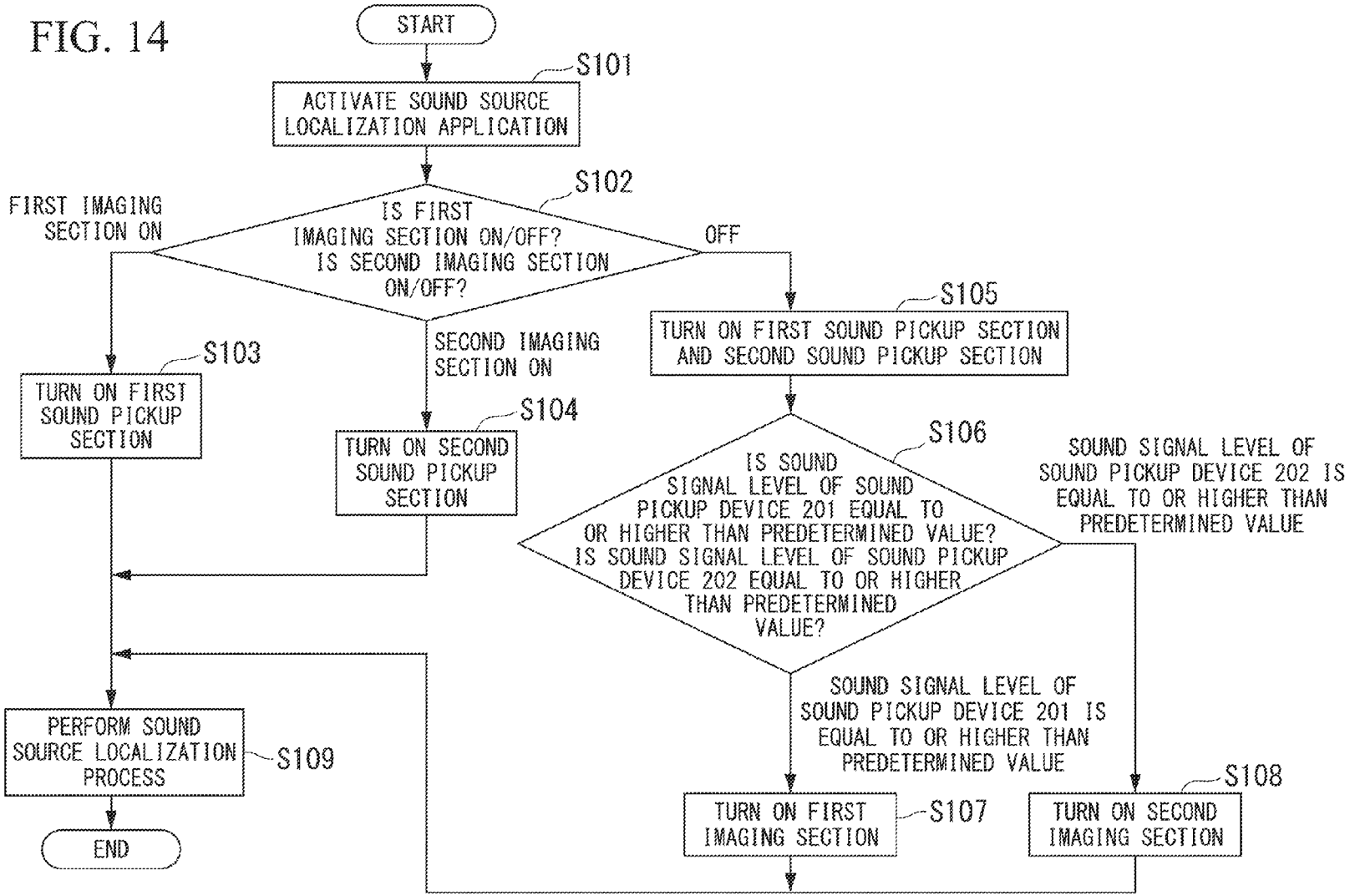
FIG. 14 is a flowchart of an operation procedure of a sound source localization device according to the second embodiment.

FIG. 14 is a flowchart of the operation procedure of the sound source localization device 10B according to the second embodiment.

In the explanation below, before activation of the sound source localization application, the first sound pickup section 21 and the second sound pickup section 22 are controlled to the off state. Moreover, in the following process, if the user selects the imaging section to be used for imaging in the operation screen of the sound source localization application, the selected imaging section (the first imaging section 41 or the second imaging section 42) is controlled to the on state by the determination section 103B. In this case, in the following process, after determination in step S102, the processes in step S103 and step S104 are performed.

On the other hand, if the user does not select the imaging section to be used for imaging in the operation screen of the sound source localization application, the first imaging section 41 and the second imaging section 42 are controlled to the off state. In this case, in the following process, after determination in step S102, the process in step S105 is performed.

(Step S101)

The application control section 112 activates the sound source localization application according to the operation information input from the operating section 111.

(Step S102)

The determination section 103B determines whether the first imaging section 41 is in the on state or the off state, and the second imaging section 42 is in the on state or the off state, based on the information indicating the detection result input from the detection section 123. If determined that the first imaging section 41 is in the on state (Step S102; the first imaging section is ON), the determination section 103B proceeds to the process in step S103. If determined that the second imaging section 42 is in the on state (step S102; the second imaging section is ON), the determination section 103B proceeds to the process in step S104. If determined that both the first imaging section 41 and the second imaging section 42 are in the off state (step S102; OFF), the determination section 103B proceeds to the process in step S105.

(Step S103)

The determination section 103B controls the first sound pickup section 21 to the on state. The determination section 103B proceeds to the process in step S109.

(Step S104)

The determination section 103B controls the second sound pickup section 22 to the on state. The determination section 103B proceeds to the process in step S109.

(Step S105)

The determination section 103B controls the first sound pickup section 21 and the second sound pickup section 22 to the on state.

(Step S106)

The determination section 103B determines whether the signal level of the sound signal of the sound pickup devices 201 has a value equal to or higher than a predetermined value, and the signal level of the sound signal of the sound pickup devices 202 has a value equal to or higher than the predetermined value, based on the information indicating the signal level input from the sound signal level detection section 121, for each of the sound pickup devices 201 and for each of the sound pickup devices 202. If determined that the signal level of the sound signal of the sound pickup devices 201 has a value equal to or higher than the predetermined value (step S106; the sound signal level of the sound pickup devices 201 has a value equal to or higher than the predetermined value), the determination section 103B proceeds to the process in step S107. If determined that the signal level of the sound signal of the sound pickup devices 202 has a value equal to or higher than the predetermined value (step S106; the sound signal level of the sound pickup devices 202 has a value equal to or higher than the predetermined value), the determination section 103B proceeds to the process in step S108.

(Step S107)

The determination section 103B controls the first sound pickup section 41 to the on state. The determination section 103B proceeds to the process in step S109.

(Step S108)

The determination section 103B controls the second sound pickup section 42 to the on state. The determination section 103B proceeds to the process in step S109.

(Step S109)

The sound source localization section 107 performs the sound source localization process by using the sound signal input from the sound signal acquisition section 106B.

With that, the operation procedure of the sound source localization device 10B is finished.

According to the above-described sound source localization device 10B, only the sound pickup section to be used for performing sound source localization and sound source separation is controlled to the on state. Therefore power consumption of the sound pickup section 20B can be reduced.

Also in the present embodiment, the determination section 103B determines the state of the sound source localization device 10B based on the result detected by the sensor 101. Then, the determination section 103B generates the first image based on the determined result.

In the example shown in FIG. 14, the example in which the user selects either the first imaging section 41 or the second imaging section 42 and controls the selected imaging section to the on state has been described. However, the present invention is not limited thereto. For example, both the first imaging section 41 and the second imaging section 42 may be in the on state. In this case, the determination section 103B may select the image captured by the first imaging section or the image captured by the second imaging section based on the brightness. For example, if the second imaging section 42 is covered with the attachment 30 or the user's hand, the brightness of the captured image of the second imaging section 42 is lower than the brightness of the captured image of the first imaging section 41. In this case, the determination section 103B may select the first imaging section 41 and the sound pickup devices 201.

Moreover, the detection section 123 may detect the first imaging section 41 or the second imaging section 42 being used for imaging, based on the size of the image of a human face included in the captured image. Specifically, in the state with the first imaging section 41 and the second imaging section 42 being in the on state, for example, when the first imaging section 41 is directed to the user side, the captured image of the first imaging section 41 includes the image of the user's face in the display section 110 with a predetermined ratio or more. It is assumed that the sound source desired to be localized is generally other than the user's voice. Therefore, in this case, the determination section 103B may use the captured image of the second imaging section 42, and the sound pickup devices 202.

Next, a display example of a result of sound source localization will be described.

Figure 15:
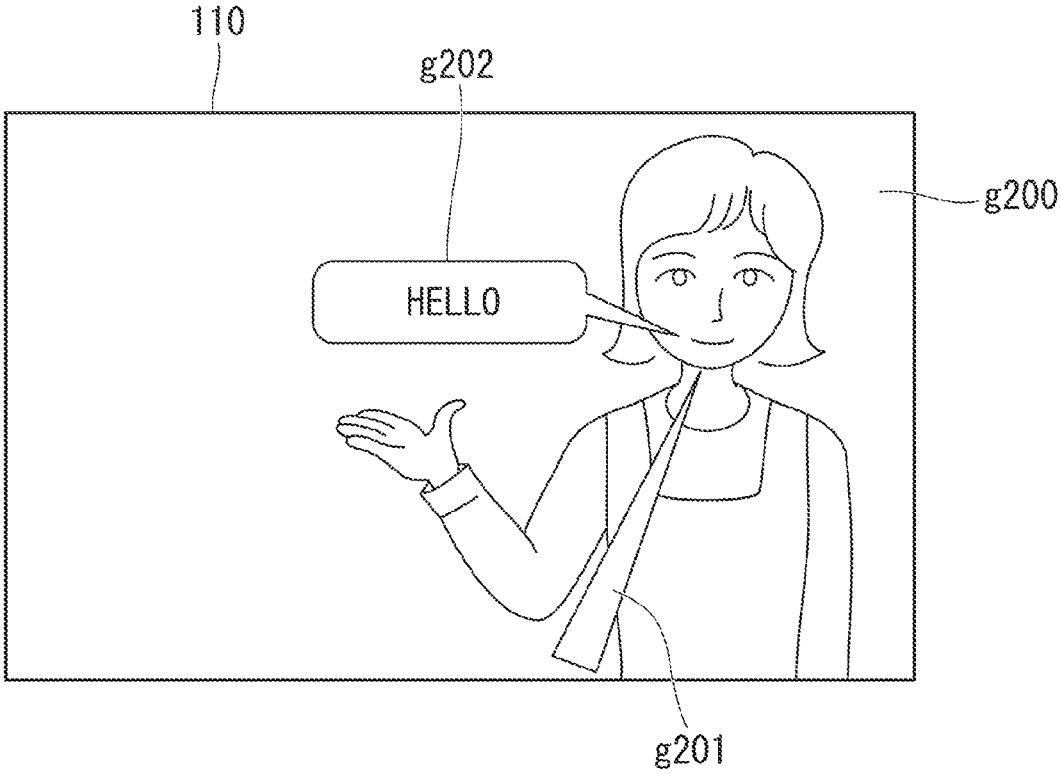
FIG. 15 is a diagram for explaining an example of a display of a result of sound source localization according to the second embodiment.

FIG. 15 is a diagram for explaining an example of a display of the result of sound source localization according to the present embodiment.

An image g200 shown in FIG. 15 is an image in which, for example, the image captured by the first imaging section 41 is synthesized with an image g201 and an image g202 being second images.

The image g201 is an image indicating the direction of the sound source. Moreover, the image g202 is an image in which a voice signal subjected to sound source localization is voice-recognized and converted to a text, and the converted text is converted to an image. The example shown in FIG. 15 is an example in which the image converted from the text is displayed as a speech balloon from a speaker's mouth, being the sound source. In such an image, for example, the detection section 123 may perform face recognition by using a known method to detect the position of the speaker's mouth, generate the image g202 of the speech balloon at the detected position of the mouth, and output the generated image to the image synthesis section 109B together with the captured image.

Furthermore, the image converted from the text may be displayed in the speech balloon for each phrase, or may be displayed by gradually enlarging the speech balloon to arrange the phrase in order of utterance.

Figure 16:
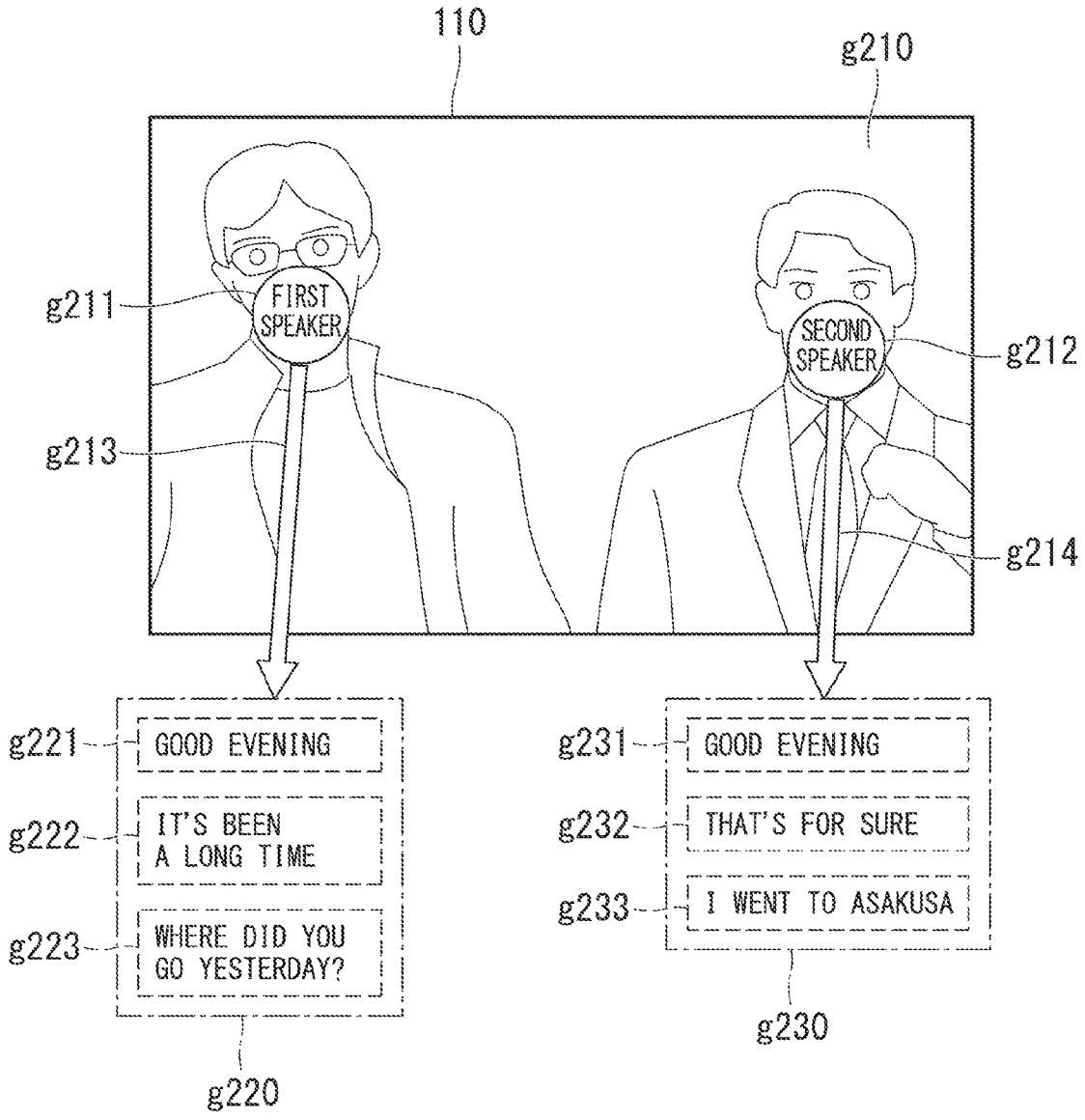
FIG. 16 is a diagram for explaining another example of a display of a result of sound source localization according to the second embodiment.

FIG. 16 is a diagram for explaining another example of a display of a result of sound source localization according to the present embodiment.

An image g210 shown in FIG. 16 is an image in which, for example, the image captured by the first imaging section 41 is synthesized with an image g211 and an image g212 being second images.

The image g211 is an image indicating the position of the sound source by a speaker 1, and the image g212 is an image indicating the position of the sound source by a speaker 2.

When the user operates the operating section 111 to select the image g211 indicating the position of the sound source, an image of an area enclosed by a chain-line square g220 as shown by the arrow g213 is displayed. The image of the area enclosed by the chain-line square g220 includes an image g221 indicating "Good evening", an image g222 indicating "It has been a long time", and an image g223 indicating "Where did you go yesterday?".

Moreover, when the user operates the operating section 111 to select the image g212 indicating the position of the sound source, an image of an area enclosed by a chain-line square g230 as shown by the arrow g214 is displayed. The image of the area enclosed by the chain-line square g230 includes an image g231 indicating "Good evening", an image g232 indicating "That's for sure", and an image g233 indicating "I went to Asakusa".

The images g221 to g223, and the images g231 to g233 are buttons, and when the user selects the respective images, the application control section 112 detects the information indicating the detected button. Then the application control section 112 outputs the detected utterance information to the output voice selection section 128. Specifically, when "Good evening" is selected, the application control section 112 outputs the utterance information indicating "Good evening" to the output voice selection section 128. Consequently, by selecting a voice recognition result by characters to be displayed on the display section 110, the user can listen to only a desired sound signal, of voice for which sound source localization and sound source separation have been performed.

Moreover, when the user selects the image g211, the application control section 112 may output information indicating the speaker 1 to the output voice selection section 128. Consequently, the user can listen to the sound signal for which sound source localization and sound source separation have been performed for each speech.

As described above, in the sound source localization device 10B according to the present embodiment, the plurality of sound pickup devices (the sound pickup devices 201-1 to **201-*n* and the sound pickup devices 202-1 to 202-*m*) are provided such that the n sound pickup devices (n is an integer equal to or larger than 2) are provided on the display section 110 side of the sound source localization device 10B and the m sound pickup devices (m is an integer equal to or larger than 2) are provided on the opposite side to the display section 110. The first microphone array is formed by the n sound pickup devices 201 and the second microphone array is formed by the m sound pickup devices 202. The sound source localization device 10B includes the first imaging section 41 provided on the display section side of the sound source localization device, the second imaging section 42 provided on the opposite side to the display section, the determination section 103B that selects either the first microphone array or the second microphone array based on an image imaged by the first imaging section and an image imaged by the second imaging section, and the sound source localization section 107** that specifies the direction of the sound source by using a sound signal recorded by the microphone array selected by the determination section.

According to the configuration, the sound source localization device 10B according to the present embodiment performs sound source localization to display the direction of the sound source on the display section 110, and displays the result of performing sound source separation and voice recognition, on the display section 110. Consequently, in a conference or a meeting, the user easily ascertains the utterance content of the respective narrators by performing imaging or recording by the sound source localization device 10B. Moreover, according to the present embodiment, by performing recording the aspects of the conference, and processing after the conference, creation of conference minutes can be supported. Furthermore, because each utterance and an image of the narrator are attached to each other, the user can recognize which narrator is speaking together with the image.

Furthermore, according to the present embodiment, because the text of the result for which sound source localization, sound separation, and voice recognition has been performed is displayed on the display section 110, a user having a hearing problem can be supported. Moreover, because the sound signal of the result for which sound source localization, sound separation, and voice recognition has been performed can be reproduced, a user having visual impairments can be supported.

First Modification Example

In the example described with reference to FIG. 14, an example in which the sound pickup devices 201 on the front side or the sound pickup devices 202 on the back side are used differently has been described. However, in a first modification example, an example in which both the first sound pickup section 21 and second sound pickup section 22 are used to perform sound source localization and sound source separation will be described.

The configuration of the sound source localization device 10B is the same as in FIG. 12.

Next, an operation procedure of the sound source localization device 10B, when the sound pickup device and the imaging section on both sides are simultaneously used will be described.

In the explanation below, before activation of the sound source localization application, all of the first imaging section 41, the second imaging section 42, the first sound pickup section 21, and the second sound pickup section 22 are controlled to the off state.

Figure 17:
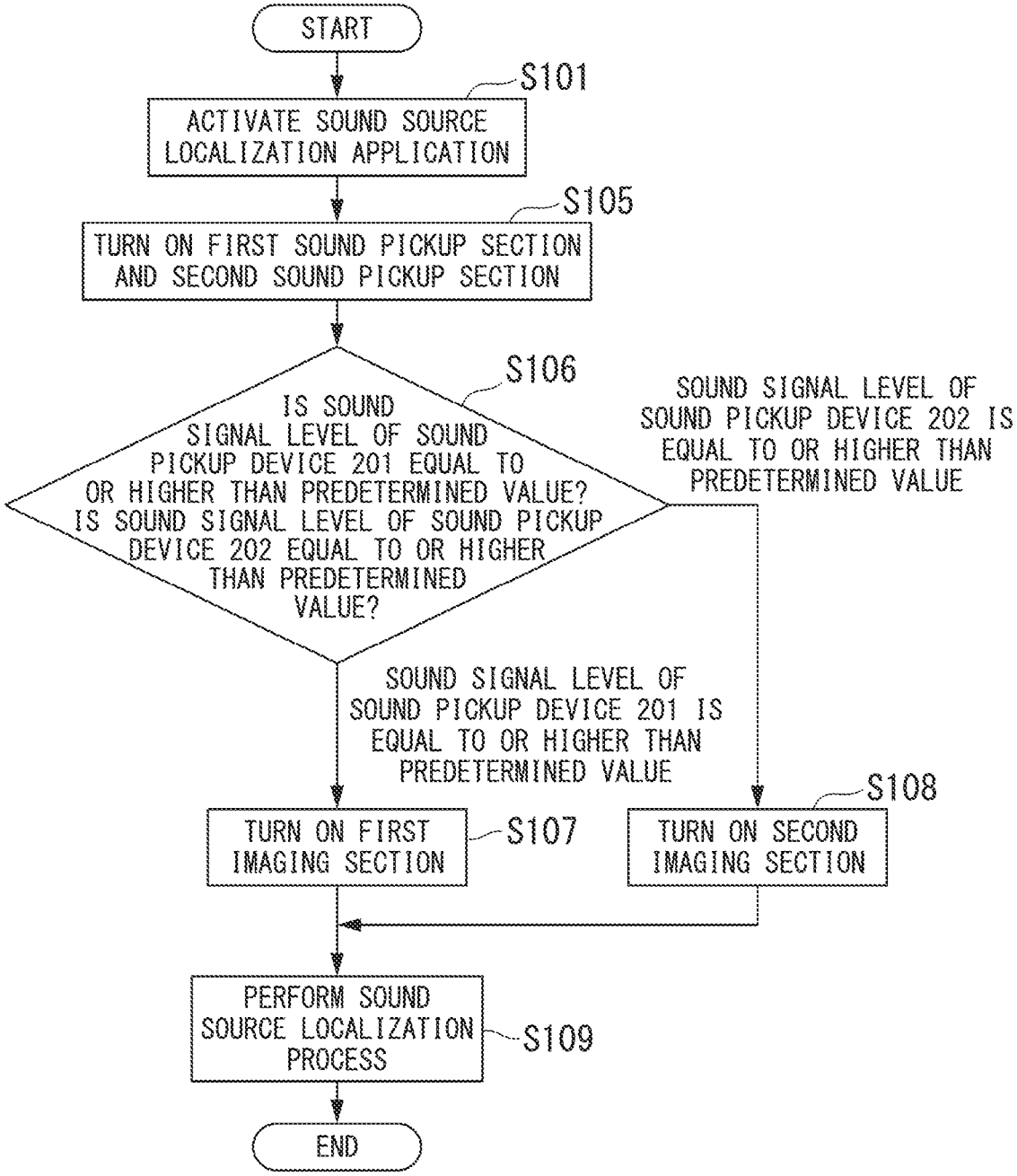
FIG. 17 is a flowchart of an operation procedure of the sound source localization device when the sound pickup devices and imaging sections on opposite sides are simultaneously used, according to the second embodiment.

FIG. 17 is a flowchart of the operation procedure of the sound source localization device 10B, when the sound pickup device and the imaging section on both sides are simultaneously used according to the present embodiment.

(Step S101)

After finishing the process, the application control section 112 proceeds to the process in step S105.

(Step S105)

The determination section 103B performs the processes in steps S105 to S108. The determination section 103B proceeds to the process in step S109.

(Step S109)

The sound source localization section 107 performs the process in step S109.

With that, the operation procedure of the sound source localization device 10B is finished.

As described above, according to the present embodiment, by simultaneously using the first imaging section 41, the second imaging section 42, the sound pickup devices 201, and the sound pickup devices 202 on both sides, an elevation angle of the sound source can be also obtained, while the sound source localization device 10B is fixed by the user. That is to say, by simultaneously using the first imaging section 41, the second imaging section 42, the sound pickup devices 201, and the sound pickup devices 202 on both sides, $\theta$ and $\phi$ in a polar coordinate system can be obtained. As a result, according to the present embodiment, a spatial map including the sound source can be generated with the sound source localization device 10B being fixed. Moreover, sound source localization and sound source separation with high accuracy can be performed by using the elevation angle of the sound source.

Furthermore, if the user moves the sound source localization device 10B so as to perform translational movement, distance information between the sound source and the sound source localization device 10B can be acquired. Sound source localization and sound source separation with higher accuracy can be performed by using this distance information.

Second Modification Example

In the example described with reference to FIG. 14, an example in which the determination section 103B controls the first sound pickup section 21, the second sound pickup section 22, the first imaging section 41, and the second imaging section 42 to the on state has been described. However, the present invention is not limited thereto. At the time of starting the sound source localization process, an example in which all of the first sound pickup section 21, the second sound pickup section 22, the first imaging section 41, and the second imaging section 42 are in the on state will be described. Specifically, in the second modification example, an example in which the recorded sound signal is selected according to the signal level, or the captured image is selected according to the brightness will be described.

Figure 18:
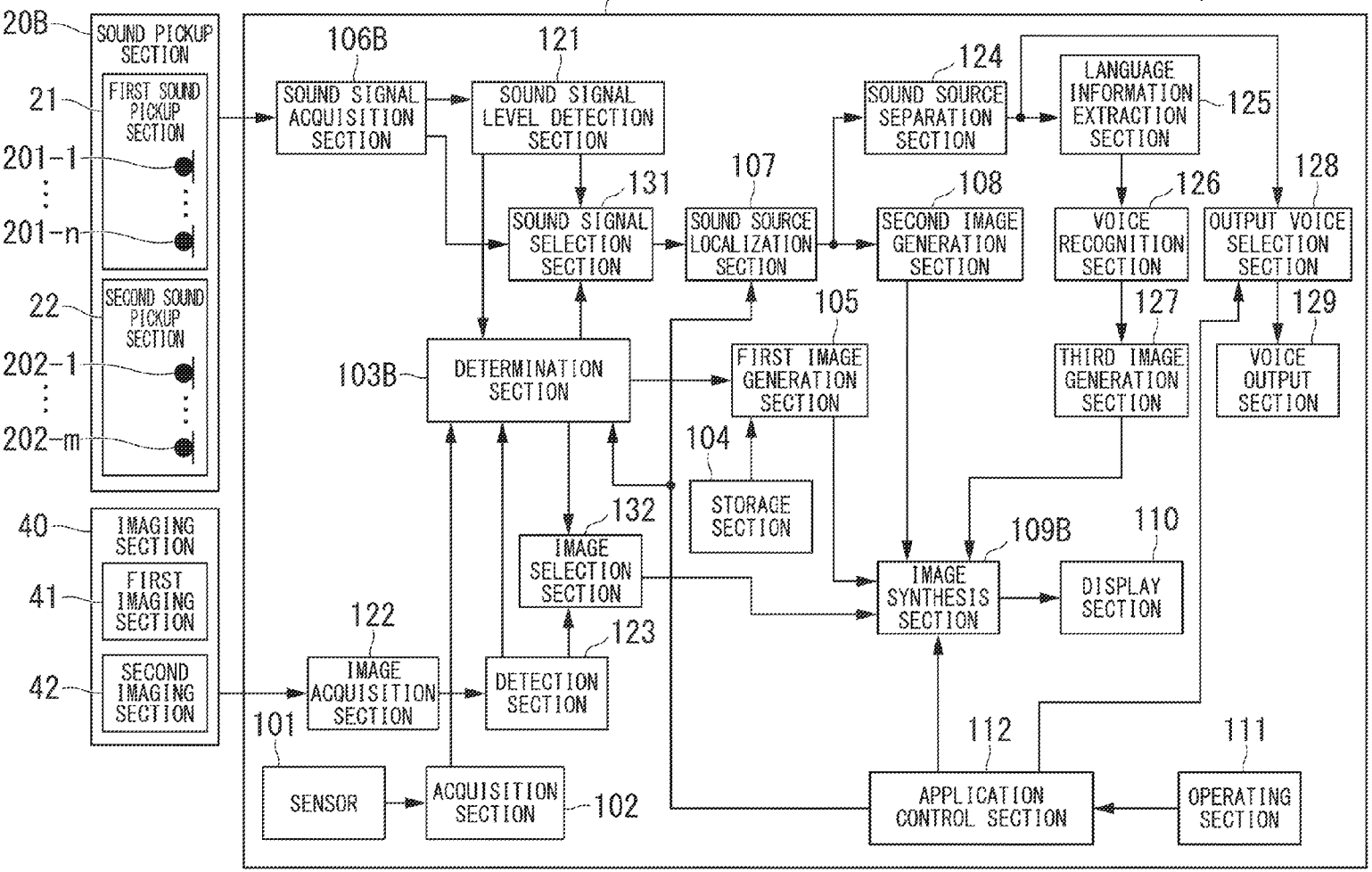
FIG. 18 is a block diagram showing a configuration of the sound processing system according to the second embodiment.

FIG. 18 is a block diagram showing a configuration of a sound processing system 1C according to the present embodiment. The sound processing system 1C shown in FIG. 18 includes a sound signal selection section 131 and an image selection section 132 in addition to the configuration of the sound processing system 1B.

The sound signal selection section 131 uses the information indicating the signal level input from the sound signal level detection section 121, and the identification information, to select a sound signal with the signal level being equal to or higher than a predetermined level. Alternatively, the sound signal selection section 131 selects the sound signal collected by the first sound pickup section 21 or the sound signal collected by the second sound pickup section 22 according to selection information input from the determination section 103B. The sound signal selection section 131 outputs the selected sound signal to the sound source localization section 107.

The image selection section 132 uses the information indicating the detection result input from the detection section 123, and the identification information, to select the captured image having the brightness of the image being, for example, a predetermined level or higher. Alternatively, the image selection section 132 selects the captured image captured by the first imaging section 41 or the captured image captured by the second imaging section 42 according to the selection information input from the determination section 103B. The image selection section 132 outputs the selected captured image to the image synthesis section 109B.

The determination section 103B further performs the following process in addition to the process of the determination section 103. When the imaging section 40 is in the on state, the determination section 103B uses the information indicating the detection result input from the detection section 123, and the identification information of the first imaging section 41 or the second imaging section 42, to select the first sound pickup section 21 or the second sound pickup section 22 to be used for sound source localization, and outputs the information indicating the selected sound pickup section as the selection information to the sound signal selection section 131. Moreover, when the imaging section 40 is in the off state, the determination section 103B uses the information indicating the signal level input from the sound signal level detection section 121, and the identification information of the sound pickup devices 201 or the sound pickup devices 202, to select the captured image of the first imaging section 41 or the captured image of the second imaging section 42, and outputs the information indicating the selected captured image as the selection information to the image selection section 132. The determination section 103B may control the unselected sound pickup section and imaging section to the off state. Thus, by controlling the unselected sound pickup section and imaging section to the off state, power consumption by the imaging section and the sound pickup section can be reduced.

As described above, the sound processing system 1C according to the present embodiment includes the detection section (the sound signal level detection section 121) that detects the signal level of the sound signals respectively recorded by the plurality of sound pickup devices (the sound pickup devices 201, the sound pickup devices 202). The determination section 103B determines whether the signal level detected by the detection section is equal to or lower than the predetermined value, and controls the sound pickup device that has recorded the sound signal with the signal level being equal to or lower than the predetermined value, to the off state, and the sound source localization section 107 specifies the direction of the sound source by using the sound signal recorded by the sound pickup device in the on state.

According to the configuration of the modification example shown in FIG. 18, the same effect as that of the sound processing system 1B can be acquired.

Third Modification Example

In the first embodiment, the example of using all the n sound pickup devices 201 has been described. Moreover, in the first modification example and the second modification example of the second embodiment, the example in which all the n sound pickup devices 201 or all the m sound pickup devices 202 are switched and used has been described. However, the present invention is not limited thereto. An example in which the sound pickup device 201 or the sound pickup device 202 covered with the user's hands are excluded, to perform sound source localization and sound source separation will be described.

The operation in the third modification example will be described with reference to FIG. 18 and FIG. 19.

Figure 19:
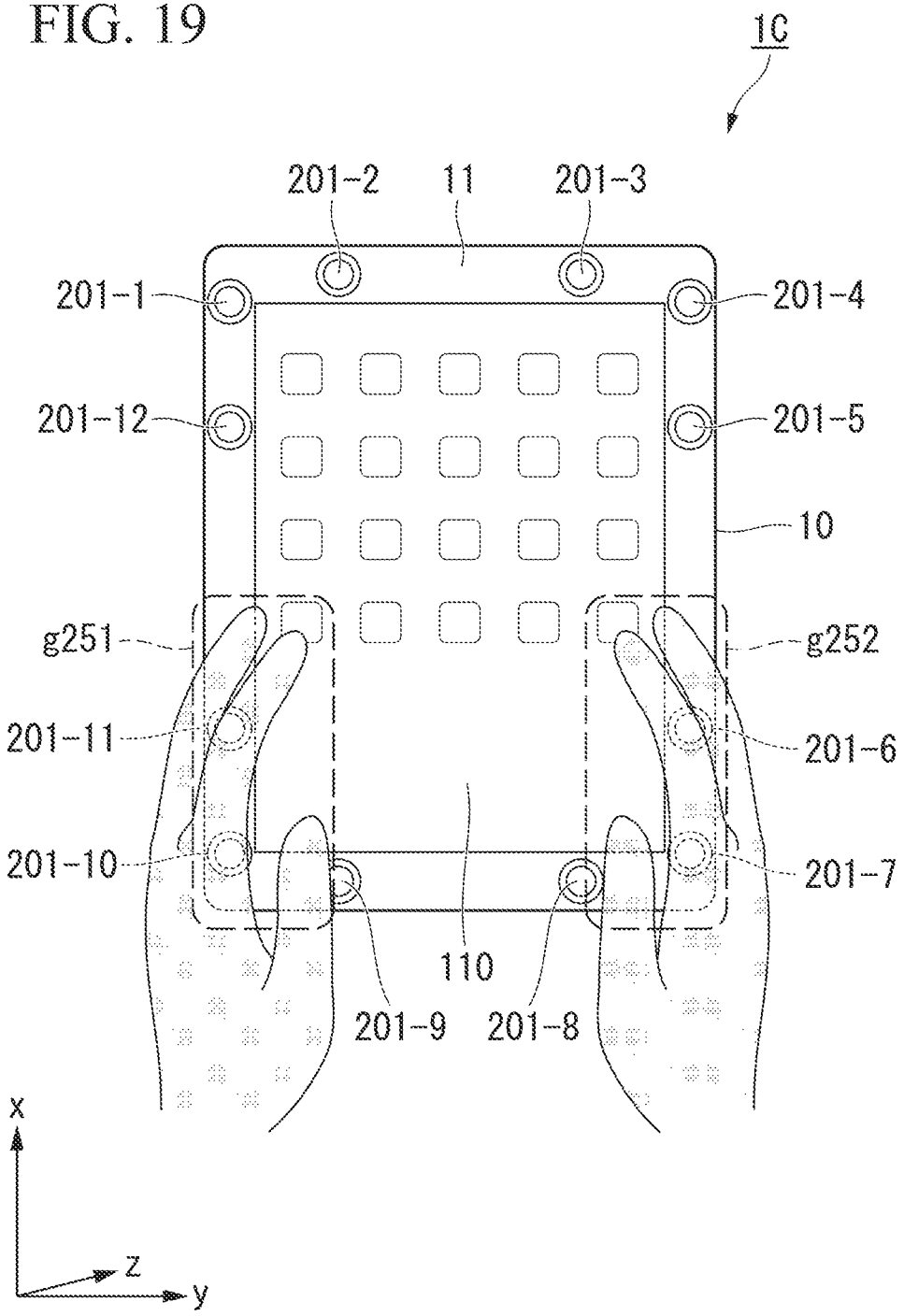
FIG. 19 is a diagram for explaining an example of an arrangement of the sound pickup devices according to the second embodiment, and a state with a user's hands being placed.

FIG. 19 is a diagram for explaining an example of an arrangement of the sound pickup devices 201 according to the present embodiment, and a state with a user's hands being placed. The example shown in FIG. 19 is an example in which twelve sound pickup devices 201 are incorporated in the frame 11. An image of an area indicated by the broken-line square g251 is an image of the user's left hand, and an image of an area indicated by the broken-line square g252 is an image of the user's right hand.

In the example shown in FIG. 19, the sound pickup device 201-6 and the sound pickup device 201-7 are covered with the right hand, and the sound pickup device 201-10 and the sound pickup device 201-11 are covered with the left hand.

The sound signal recorded by the sound pickup device 201 or the sound pickup device 202 covered with the user's hand has a signal level lower than that of the sound signal recorded by the sound pickup device 201 or the sound pickup device 202 that is not covered with the hand. Consequently, the sound signal selection section 131 determines that the sound pickup device 201 having the signal level equal to or lower than the predetermined value is covered with the user's hand. Then the sound signal selection section 131 selects only the sound signals of the sound pickup devices determined as not being covered with the user's hand.

Next, an operation procedure when the sound pickup device is covered with the user's hand will be described.

Figure 20:
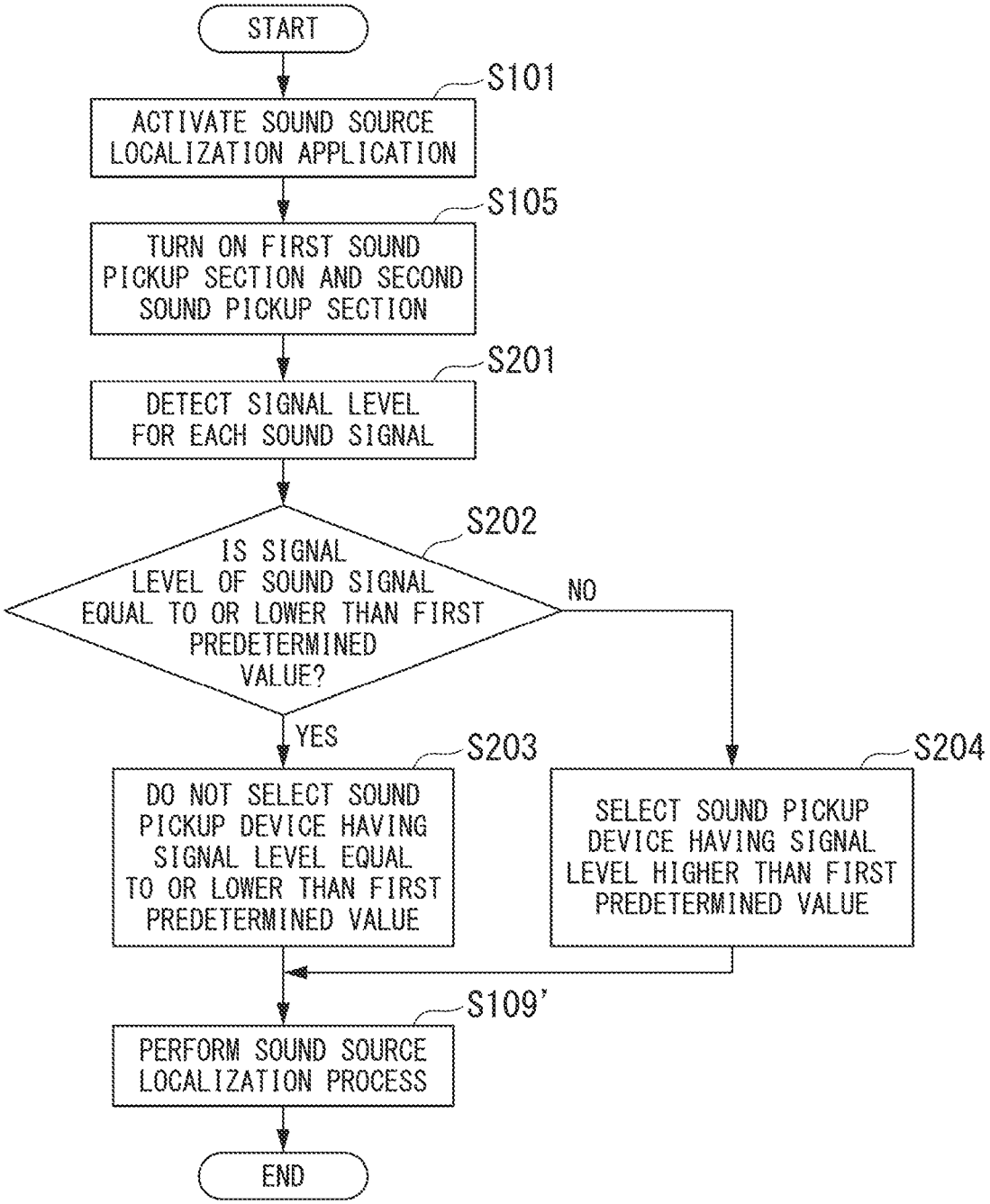
FIG. 20 is a flowchart of an operation procedure of the sound source localization device when the sound pickup device is covered with the user's hands, according to the second embodiment.

FIG. 20 is a flowchart of the operation procedure of the sound source localization device 10C according to the present embodiment, when the sound pickup device is covered with the user's hands. Processes similar to those described with reference to FIG. 14 and the like are denoted by the same reference symbols.

(Step S201)

After finishing the process in step S105, the sound signal level detection section 121 detects the signal level for each sound signal input from the sound signal acquisition section 106B.

(Step S202)

The sound signal selection section 131 determines for each sound signal whether the signal level of the sound signal input from the sound signal acquisition section 106B is equal to or lower than a first predetermined value. If the signal level is equal to or lower than the first predetermined value (step S202; YES), the sound signal selection section 131 proceeds to the process in step S203. If the signal level is higher than the first predetermined value (step S202; NO), the sound signal selection section 131 proceeds to the process in step S204. For example, the first predetermined value may be an originally set value, or may be a value set by the user.

(Step S203)

The sound signal selection section 131 does not select the sound signal of the sound pickup device having the signal level equal to or lower than the first predetermined value. The determination section 103B proceeds to the process in step S109'.

(Step S204)

The sound signal selection section 131 selects the sound signal of the sound pickup device having the signal level higher than the first predetermined value. The determination section 103B proceeds to the process in step S109'.

(Step S109')

The sound source localization section 107 performs the sound source localization process by using the sound signal selected by the sound signal selection section 131.

With that, the operation procedure of the sound source localization device 10C is finished.

Here, an example of the sound source localization process performed by the sound source localization section 107 when the sound signal of the sound pickup device being covered with the hand is excluded will be described.

For example, in the case of using the MUSIC method, the spatial spectrum $P_M(\theta)$ is estimated by using the above equation (1). In this case, when the number of sound pickup devices 202 is M, in equation (1), the number obtained by subtracting the number of unselected sound pickup devices 202 from M is used to calculate the spatial spectrum $P_M(\theta)$ according to equation (1). For example, in the example shown in FIG. 19, because the sound pickup devices 201-6, 201-7, 201-10, and 201-11 of the twelve sound pickup devices 201 are not selected, an arithmetic operation is performed using equation (1), assuming M=8(=12−4).

Also in the Beam Forming method or the like, similarly, an item corresponding to the excluded sound signal is excluded to perform the sound source localization process.

In the above-described example, an example in which the sound signal selection section 131 selects the sound signal of the sound pickup device 201 or the sound pickup device 202 that is determined as not being covered with the user's hand has been described. However, the present invention is not limited thereto.

For example, according to the configuration shown in FIG. 12, the determination section 103B may determine that the sound pickup device 201 having the signal level equal to or lower than the predetermined value is covered with the user's hand, by using the information indicating the signal level input from the sound signal level detection section 121, and the identification information of the sound pickup device 201. Then the determination section 103B may control the sound pickup device 201 determined as being covered with the user's hand, to the off state.

As described above, the sound source localization device 10C according to the present embodiment includes the detection section (the sound signal level detection section 121) that detects the signal level of the sound signals respectively recorded by the plurality of sound pickup devices (the sound pickup devices 201, and the sound pickup devices 202), and the sound signal selection section 131 that selects a sound signal with the signal level higher than the predetermined value from the sound signals, and the sound source localization section 107 specifies the direction of the sound source by using the sound signal selected by the sound signal selection section.

Moreover, the sound source localization device 10B according to the present embodiment includes the detection section (the sound signal level detection section 121) that detects the signal level of the sound signals respectively recorded by the plurality of sound pickup devices (the sound pickup devices 201, the sound pickup devices 202). The determination section 103B determines whether the signal level detected by the detection section is equal to or lower than the predetermined value, and controls the sound pickup device that has recorded the sound signal with the signal level being equal to or lower than the predetermined value, to the off state. The sound source localization section 107 specifies the direction of the sound source by using the sound signal recorded by the sound pickup device in the on state.

According to this configuration, the sound source localization device 10B or the sound source localization device 10C can perform sound source localization, sound source separation, and voice recognition by excluding the sound pickup device having a low-level voice signal level, which is covered with the user's hand. Consequently, the accuracy of sound source localization, sound source separation, and voice recognition can be improved.

In the example shown in FIG. 20, in step S202, an example in which the sound signal is not selected if the signal level of the sound signal is equal to or lower than the first predetermined value has been described. However, the present invention is not limited thereto. This is because if the signal level of the sound signal is equal to or higher than the second predetermined value, a distortion may occur in the sound signal. If the process of sound source localization and sound source separation is performed by using the sound signal in which a distortion has occurred, the accuracy thereof may decrease. Consequently, the sound signal selection section 131 need not select the sound signal in which the signal level of the sound signal input from the sound signal acquisition section 106B is equal to or higher than the second predetermined value.

In the third modification example, an example in which it is determined that the sound pickup device 201 or the sound pickup device 202 is covered with the user's hand based on the level of the sound signal has been described. However, the present invention is not limited thereto. The application control section 112 may detect the position where the user's hand is placed on the operating section 111, being a touch panel sensor, based on an output of the sensor. Then the application control section 112 may determine that the sound pickup device corresponding to the detected position is covered with the hand.

Third Embodiment

In the first embodiment and the second embodiment, an example in which the sound source localization devices 10, 10A, 10B, and 10C include the sound source localization section 107 has been described. However, the sound source localization section 107 may be provided in the attachment 30 together with the sound pickup section 20.

In the third embodiment, an example in which a sound source localization unit including a sound pickup section attached to the attachment such as a cover, a sound source localization section, and a communication section, performs sound source localization and transmits a result of sound source localization and a recorded sound signal to a tablet terminal or the like will be described.

Figure 21:
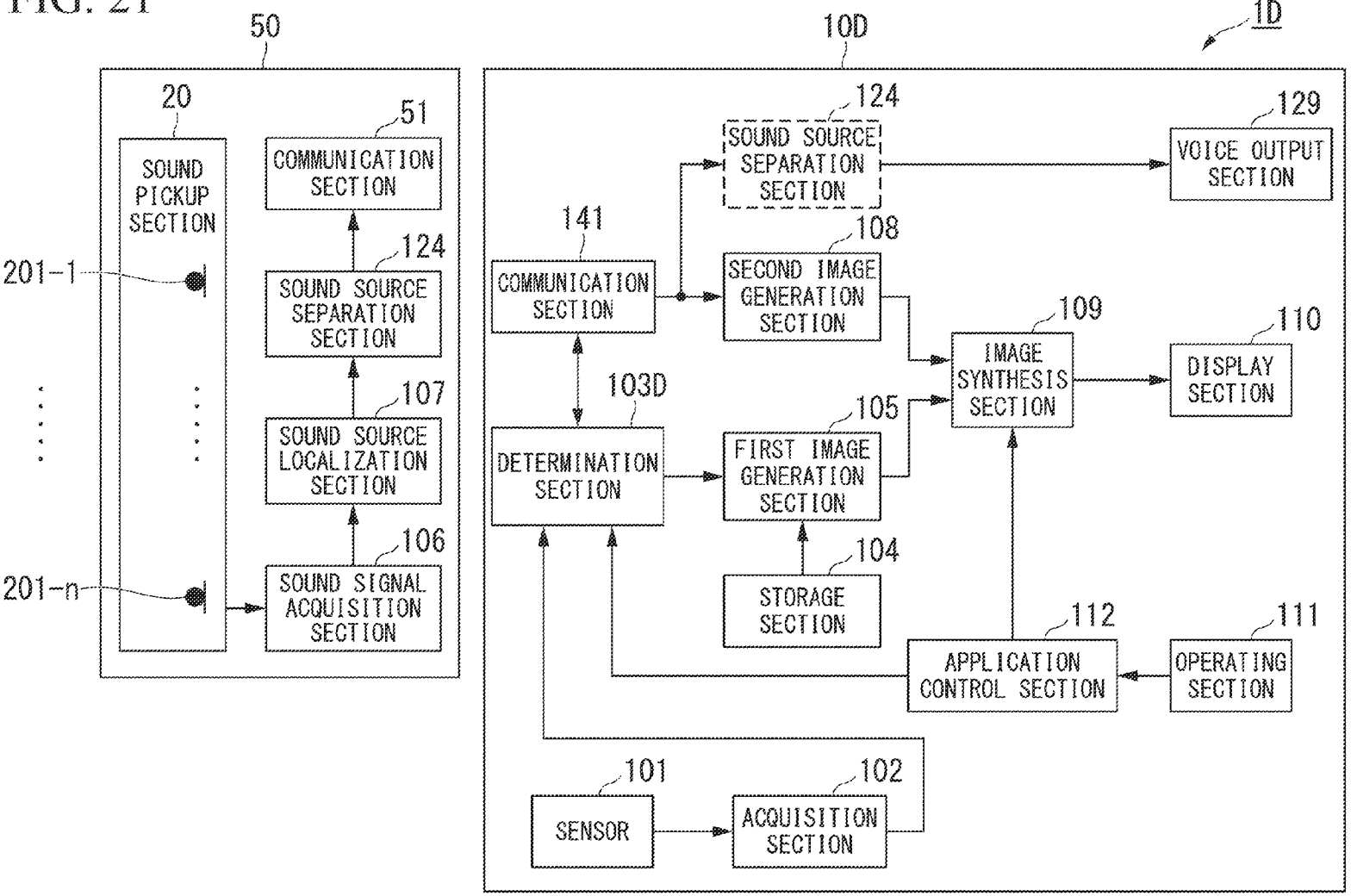
FIG. 21 is a block diagram showing a configuration of a sound processing system according to a third embodiment.

FIG. 21 is a block diagram showing a configuration of a sound processing system 1D according to the present embodiment. As shown in FIG. 21, the sound processing system 1D includes an information output device 10D and a sound source localization unit 50. The information output device 10D is, for example, a mobile terminal, a tablet terminal, a mobile game terminal, or a notebook personal computer. In the explanation below, an example in which the information output device 10D is a tablet terminal will be described.

In the example shown in FIG. 21, an example in which the present embodiment is applied to the sound processing system 1 will be described. However, the present embodiment may be applied to the sound processing system 1A, the sound processing system 1B, and the sound processing system 1C. Moreover, functional sections having the same functions as those of the sound processing system 1 and the sound processing system 1B are denoted by the same reference symbols, and explanation thereof is omitted.

The sound source localization unit 50 is attached to the attachment 30 (see FIG. 8). The sound source localization unit 50 includes the sound pickup section 20, the sound signal acquisition section 106, the sound source localization section 107, the sound source separation section 124, and a communication section 51. The sound source localization unit 50 and the information output device 10D perform transmission and reception of information by wireless or by cable. The sound source localization unit 50 includes a power source (not shown).

The sound source localization section 107 outputs estimated azimuth angle information, and input n sound signals, to the sound source separation section 124.

The sound source separation section 124 acquires n-channel sound signals output from the sound source localization section 107, and separates the acquired n-channel or m-channel sound signals into a sound signal for each speaker by using, for example, the GHDSS method. The sound source separation section 124 outputs the separated sound signal for each speaker, and the azimuth angle information input from the sound source localization section 107, to the communication section 51.

The communication section 51 transmits the sound signal for each speaker input from the sound source separation section 124 in association with the azimuth angle information, to the information output device 10D.

The information output device 10D includes; the sensor 101, the acquisition section 102, a determination section 103D, the storage section 104, the first image generation section 105, the second image generation section 108, the image synthesis section 109, the display section 110, the operating section 111, the application control section 112, the voice output section 129, and a communication section 141.

The communication section 141 outputs the azimuth angle information received from the sound source localization unit 50, to the second image generation section 108, and outputs the received sound signal for each speaker, to the voice output section 129.

In the example shown in FIG. 21, an example in which the sound source localization unit 50 includes the sound pickup section 20, the sound signal acquisition section 106, the sound source localization section 107, the sound source separation section 124, and the communication section 51 has been described. However, the present invention is not limited thereto. For example, the sound source localization unit 50 may include the sound pickup section 20, the sound signal acquisition section 106, the sound source localization section 107, and the communication section 51, and the information output device 10D may include the sound source separation section 124. In this case, the communication section 51 may transmit the n sound signals input from the sound source localization section 107 in association with the azimuth angle information, to the information output device 10D. The sound source separation section 124 of the information output device 10D may perform the process of sound source separation based on the received n sound signals and the azimuth angle information.

Moreover, the communication section 51 may also transmit information indicating the positions of the sound pickup devices 201. In this case, the communication section 141 of the information output device 10D may extract the information indicating the positions of the sound pickup devices 201 from the received information, and output the extracted information indicating the positions of the sound pickup devices 201, to the determination section 103D. Then the determination section 103D may output a determination result obtained by determining the direction of the sound source localization device 10 based on rotation angle information or an angular speed input from the acquisition section 102, and the information indicating the positions of the sound pickup devices 201 input from the communication section 51, to the first image generation section 105.

Consequently, also in the present embodiment, the information output device 10D can display an image indicating a position to arrange the hands on the display section 110, the frame 11, or the like, based on the positions of the sound pickup devices 201 of the sound source localization unit 50 and the direction of the information output device 10D held by the user.

As described above, the sound processing system 1D according to the present embodiment is a sound processing system including the sound source localization unit 50 and the information output device 10D, wherein the sound source localization unit includes; the sound pickup section 20 having a plurality of sound pickup devices (the sound pickup devices 201) that record a sound signal, the sound source localization section 107 that estimates the azimuth angle of the sound source by using the sound signal recorded by the sound pickup section, and the transmission section (the communication section 51) that transmits the direction of the sound source and a plurality of sound signals recorded by the sound pickup devices. The information output device includes; a reception section (the communication section 141) that receives the information indicating the direction of the sound source and the plurality of sound signals transmitted from the sound source localization unit, and the sound source separation section 124 that performs sound source processing to separate sound signals for each sound source, based on the information indicating the direction of the sound source and the plurality of sound signals received by the reception section.

According to the above-described configuration, the information output device 10D can perform the sound signal separation process based on the sound signals recorded by the plurality of sound pickup devices and the information indicating the azimuth angle of the sound source, which are received from the sound source localization unit 50.

Moreover, in the sound processing system 1D according to the present embodiment, the transmission section (the communication section 51) of the sound source localization unit 50 transmits information indicating positions of the plurality of sound pickup devices (the sound pickup devices 201), the reception section (the communication section 141) of the information output device 10D receives the information indicating the positions of the plurality of sound pickup devices transmitted from the sound source localization unit, and the sound source localization device includes the notification device (the determination section 103D, the first image generation section 105, the image synthesis section 109, the display section 110) that notifies information based on the arrangement of the sound pickup devices, based on the received information indicating the positions of the plurality of sound pickup devices.

According to the above-described configuration, the information output device 10D can notify information based on the arrangement of the sound pickup devices, based on the information indicating the positions of the plurality of sound pickup devices (the sound pickup devices 201, the sound pickup devices 202), received from the sound source localization unit 50. Consequently, according to the present configuration, the user can arrange the hand at a position that does not cover the sound pickup device by confirming the notified information. As a result, according to the present configuration, because the sound pickup device is not covered with the user's hand, the accuracy of sound source localization can be improved by using the sound signals recorded by the plurality of sound pickup devices.

The sound processing system 1D may include the first sound pickup section 21, the second sound pickup section 22 (FIG. 12), and the imaging section 40 (FIG. 12). The information output device 10D may include the imaging section 40. In this case, the determination section 103D of the information output device 10D may select the microphone array to be used for sound source localization, based on a captured image captured by the first imaging section 41, and a captured image captured by the second imaging section 42. The determination section 103D may transmit information indicating the selection result to the sound source localization unit 50 via the communication section 141. The sound source localization unit 50 may control whether to perform the process of sound source localization and sound source separation by using the sound signal recorded by the first sound pickup section 21 or to perform the process of sound source localization and sound source separation by using the sound signal recorded by the second sound pickup section 22, based on the information indicating the selection result received via the communication section 51.

Moreover, also in the present embodiment, as in the third modification example of the second embodiment, the sound source localization unit 50 may include the sound signal level detection section 121 (FIG. 12), and select the sound signal to be used for sound source localization and sound source separation according to the detected signal level of the sound signal.

A device that incorporates the above-described sound source localization device 10 (10A, 10B, 10C, and 10D) may be, for example, a robot, a vehicle, a mobile terminal, or an IC recorder. Moreover, in this case, the robot, the vehicle, the mobile terminal, or the IC recorder may include the sound pickup section 20, the imaging section 40, the sensor 101, and the operating section 111.

A program for realizing the function of the sound source localization device 10 (10A, 10B, 10C, and 10D) of the present invention may be recorded in a computer readable recording medium, and the program recorded in the recording medium may be read and executed by a computer system, thereby estimating the sound source direction. The "computer system" referred to herein includes hardware such as an OS and a peripheral device. Moreover, the "computer system" includes a WWW system including a website providing environment (or a display environment). Furthermore, the "computer readable recording medium" stands for portable media such as a flexible disk, a magnetooptic disk, a ROM, and a CD-ROM, or a storage device such as a hard disk or the like incorporated in the computer system. Furthermore, the "computer readable recording medium" includes a medium that holds a program for a certain period of time such as a volatile memory (RAM) in the computer system, which becomes a server or a client when the program is transmitted via a network such as the Internet or a communication line such as a telephone line.

Moreover, the above program may be transmitted from a computer system having this program in a memory device thereof to another computer system via a transmission medium, or by means of transmitted waves within the transmission medium. Here, the "transmission medium" that transmits the program refers to a medium having an information transmission function such as a network including the Internet (communication network) or a communication line including a telephone line (communication wire). Furthermore, the above program may realize a part of the functions described above. Moreover, it may be a so-called difference file (difference program) that can realize the functions described above in combination with a program recorded beforehand in the computer system.

What is claimed is:

1. A sound source localization device that has a plurality of sound pickup devices which record a sound signal and specifies a direction of a sound source based on sound signals recorded by at least two sound pickup devices of the plurality of sound pickup devices, the sound source localization device comprising:

a notification device that notifies a user of information based on an arrangement of the plurality of sound pickup devices, wherein, as the plurality of sound pickup devices, n (n is an integer equal to or larger than 2) sound pickup devices are provided on a display section side of the sound source localization device, and m (m is an integer equal to or larger than 2) sound pickup devices are provided on an opposite side to the display section, wherein a first microphone array is formed by the n sound pickup devices, and a second microphone array is formed by the m sound pickup devices, and wherein there is further provided:

a first imaging section provided on the display section side of the sound source localization device;

a second imaging section provided on the opposite side to the display section;

a determination section that selects either the first microphone array or the second microphone array based on an image imaged by the first imaging section and an image imaged by the second imaging section; and a sound source localization section that specifies the direction of the sound source by using a sound signal recorded by the microphone array selected by the determination section.

2. The sound source localization device according to claim 1, wherein the notification device is at least one device of:

a device that notifies the user of information indicating a position where a user's hand is placed on a display section, a device that notifies the user of information indicating a position where the user's hand is placed on a frame of the display section, a device that notifies the user of information indicating a position where the user's hand is placed on an attachment attached to the sound source localization device, a device printed with the position where the user's hand is placed on the frame of the display section, a device printed with the position where the user's hand is placed on the attachment, and a device that notifies the user of positions where the sound pickup devices of the plurality of sound pickup devices are arranged.

3. The sound source localization device according to claim 1, further comprising:

a sensor that detects a direction of the sound source localization device set by the user, wherein the notification device notifies the user of the information based on the arrangement of the plurality of sound pickup devices according to the direction detected by the sensor.

4. The sound source localization device according to claim 1, further comprising:

a detection section that detects a signal level of the sound signal respectively recorded by the plurality of sound pickup devices; and a sound signal selection section that selects a sound signal with the signal level higher than a predetermined value from the sound signals, wherein the sound source localization section specifies the direction of the sound source by using the sound signal selected by the sound signal selection section.

5. The sound source localization device according to claim 1, further comprising:

a detection section that detects a signal level of the sound signal respectively recorded by the plurality of sound pickup devices, wherein the determination section determines whether the signal level detected by the detection section is equal to or lower than a predetermined value, and controls the sound pickup device that has recorded the sound signal with the signal level being equal to or lower than the predetermined value, to an off state, and wherein the sound source localization section specifies the direction of the sound source by using the sound signal recorded by the sound pickup device in an on state.

6. A sound processing system comprising a sound source localization unit and an information output device, wherein the sound source localization unit includes:

a plurality of sound pickup devices that record a sound signal;

a sound source localization section that estimates a direction of a sound source by using sounds signal recorded by the plurality of sound pickup devices; and a transmission section that transmits the direction of the sound source and sound signals recorded by the plurality of sound pickup devices, and the information output device includes:

a reception section that receives information indicating the direction of the sound source and the plurality of sound signals transmitted from the sound source localization unit; and a sound source separation section that performs sound source processing to separate sound signals for each sound source, based on the information indicating the direction of the sound source and the plurality of sound signals received by the reception section.

7. The sound processing system according to claim 6, wherein the transmission section of the sound source localization unit transmits information indicating positions of the plurality of sound pickup devices, the reception section of the information output device receives the information indicating the positions of the plurality of sound pickup devices transmitted from the sound source localization unit, and the information output device further includes a notification device that notifies information based on an arrangement of the plurality of sound pickup devices, based on the received information indicating the positions of the plurality of sound pickup devices.

8. A control method of a sound source localization device that has a plurality of sound pickup devices which record a sound signal and specifies a direction of a sound source based on sound signals recorded by at least two sound pickup devices of the plurality of sound pickup devices, the control method comprising:

a notification procedure of notifying a user of information based on an arrangement of the plurality of sound pickup devices according to a direction of the sound source localization device set by the user, which is detected by a sensor;

a detection procedure of detecting a signal level of the sound signal respectively recorded by the plurality of sound pickup devices;

a sound signal selection procedure of selecting a sound signal with the signal level higher than a predetermined value from the sound signals; and a sound source localization procedure of specifying the direction of the sound source by using the sound signal selected by the sound signal selection procedure.

9. The control method of the sound source localization device according to claim 8, further comprising:

a determination procedure of determining whether the signal level detected by the detection procedure is equal to or lower than the predetermined value, to control the sound pickup device that has recorded the sound signal with the signal level being equal to or lower than the predetermined value, to an off state; and a sound source localization procedure of specifying the direction of the sound source by using the sound signal recorded by the sound pickup device that is controlled to an on state by the determination procedure.

* * * * *